US009234395B2

(12) United States Patent
Angelle et al.

(10) Patent No.: US 9,234,395 B2
(45) **Date of Patent: *Jan. 12, 2016**

(54) TUBULAR GUIDING AND GRIPPING APPARATUS AND METHOD

(71) Applicant: Frank's International, LLC, Houston, TX (US)

(72) Inventors: Jeremy Richard Angelle, Youngsville, LA (US); Donald E. Mosing, Lafayette, LA (US); Robert Thibodeaux, Jr., Lafayette, LA (US); Blaine Stephen LaFleur, Sunset, LA (US); John Erick Stelly, Breaux Bridge, LA (US)

(73) Assignee: Frank's International, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/617,654

(22) Filed: Feb. 9, 2015

(65) Prior Publication Data

US 2015/0152699 A1 Jun. 4, 2015

Related U.S. Application Data

(63) Continuation of application No. 13/658,503, filed on Oct. 23, 2012, now Pat. No. 8,950,475, which is a continuation of application No. 12/771,836, filed on Apr. 30, 2010, now Pat. No. 8,316,929, which is a (Continued)

(51) Int. Cl.
*E21B 19/07* (2006.01)
*E21B 19/10* (2006.01)

(Continued)

(52) U.S. Cl.
CPC ..... *E21B 19/24* (2013.01); *E21B 17/012* (2013.01); *E21B 17/1057* (2013.01); *E21B 19/07* (2013.01); *E21B 19/10* (2013.01); *Y10T 29/49826* (2015.01)

(58) Field of Classification Search
CPC ..... E21B 19/004; E21B 19/07; E21B 19/10
USPC ..... 166/350, 75.14, 77.51, 85.5
See application file for complete search history.

(56) References Cited

U.S. PATENT DOCUMENTS 370,744 A 9/1887 Mixer et al.
1,280,850 A 10/1918 Robichaux et al.

(Continued)

FOREIGN PATENT DOCUMENTS

DE 3537471 C1 1/1987
EP 1619349 A2 1/2006

(Continued)

OTHER PUBLICATIONS

Extended European Search Report issued in related European Application No. 09822742.4, mailed May 15, 2015 (6 pages).

(Continued)

*Primary Examiner* — Matthew R Buck
(74) *Attorney, Agent, or Firm* — Osha Liang LLP

(57) ABSTRACT

A method and an apparatus to guide a tubular member are described herein. The apparatus includes a bore with a longitudinal axis extending therethrough and configured to support a tubular member, the apparatus having a first opening formed at a first side thereof, a second opening formed at a second side thereof, and an inner wall extending from the first opening to the second opening. The apparatus further includes a first guiding member disposed adjacent to the first opening of the bowl and a second guiding member disposed adjacent to the second opening of the bowl.

11 Claims, 24 Drawing Sheets

Related U.S. Application Data continuation-in-part of application No. 12/126,072, filed on May 23, 2008, now Pat. No. 7,992,634, which is a continuation-in-part of application No. 11/846,169, filed on Aug. 28, 2007, now Pat. No. 7,997,333.

(51) Int. Cl.

| | |
|---|---|
| ***E21B 19/24*** | (2006.01) |
| ***E21B 17/01*** | (2006.01) |
| ***E21B 17/10*** | (2006.01) |

(56) References Cited

U.S. PATENT DOCUMENTS

| | | | | |
|---|---|---|---|---|
| 1,446,568 | A | 2/1923 | Krell | |
| 1,548,543 | A | 8/1925 | Moody | |
| 1,669,401 | A | 5/1928 | Davis | |
| 2,048,209 | A | 7/1936 | Young et al. | |
| 2,065,140 | A | 12/1936 | Lundeen | |
| 2,263,364 | A | 11/1941 | Nichols | |
| 2,283,082 | A * | 5/1942 | Miether | 175/423 |
| 2,306,130 | A * | 12/1942 | Long | 464/165 |
| 2,578,056 | A | 12/1951 | French | |
| 2,607,098 | A * | 8/1952 | Wilson | 188/67 |
| 2,623,257 | A * | 12/1952 | Moon | 188/67 |
| 2,810,178 | A | 10/1957 | Taylor | |
| 2,852,301 | A | 9/1958 | Gentry | |
| 2,998,084 | A | 8/1961 | Johnson et al. | |
| 3,043,619 | A | 7/1962 | George et al. | |
| 3,167,137 | A | 1/1965 | Humphrey | |
| 3,424,257 | A | 1/1969 | Kotlyarov et al. | |
| 3,454,297 | A | 7/1969 | Turner | |
| 3,457,605 | A * | 7/1969 | Kingsbury | E21B 3/04 175/195 |
| 3,472,535 | A * | 10/1969 | Kinley | E21B 19/10 188/67 |
| 3,495,864 | A | 2/1970 | Jones et al. | |
| 3,623,558 | A | 11/1971 | Brown | |
| 3,748,702 | A * | 7/1973 | Brown | E21B 19/10 188/67 |
| 4,269,277 | A | 5/1981 | Baugh | |
| 4,306,339 | A | 12/1981 | Ward | |
| 4,449,596 | A | 5/1984 | Boyadjieff | |
| 4,511,168 | A | 4/1985 | Haynes | |
| 4,654,950 | A | 4/1987 | Maidlow | |
| 4,657,439 | A * | 4/1987 | Petersen | 405/200 |
| 4,715,456 | A | 12/1987 | Poe, Jr. et al. | |
| 4,715,625 | A * | 12/1987 | Shows et al. | 285/123.11 |
| 5,005,650 | A | 4/1991 | Hopper | |
| 5,107,931 | A | 4/1992 | Valka et al. | |
| 5,442,965 | A | 8/1995 | Halén | |
| 5,848,647 | A | 12/1998 | Webre et al. | |
| 6,000,472 | A | 12/1999 | Albright et al. | |
| 6,394,186 | B1 | 5/2002 | Whitelaw et al. | |
| 6,394,201 | B1 | 5/2002 | Feigel, Jr. et al. | |
| 6,431,626 | B1 | 8/2002 | Bouligny | |
| 6,651,737 | B2 | 11/2003 | Bouligny et al. | |
| 6,814,149 | B2 | 11/2004 | Liess et al. | |
| 6,994,176 | B2 | 2/2006 | Shahin et al. | |
| 7,143,849 | B2 | 12/2006 | Shahin et al. | |
| 7,367,403 | B2 | 5/2008 | Webre et al. | |
| 7,383,885 | B2 * | 6/2008 | Bergeron et al. | 166/345 |
| 7,395,855 | B2 | 7/2008 | Ayling | |
| 7,546,884 | B2 | 6/2009 | Veeningen et al. | |
| 7,992,634 | B2 | 8/2011 | Angelle et al. | |
| 7,997,333 | B2 | 8/2011 | Angelle et al. | |
| 8,002,027 | B2 | 8/2011 | Angelle et al. | |
| 8,573,308 | B2 * | 11/2013 | Baugh | 166/355 |
| 8,950,475 | B2 * | 2/2015 | Angelle et al. | 166/77.1 |
| 2004/0016575 | A1 | 1/2004 | Shahin et al. | |
| 2004/0200622 | A1 | 10/2004 | Jennings | |
| 2004/0251055 | A1 | 12/2004 | Shahin et al. | |
| 2006/0108122 | A1 * | 5/2006 | Buytaert et al. | 166/379 |
| 2006/0225891 | A1 | 10/2006 | Adams et al. | |
| 2007/0158079 | A1 | 7/2007 | Webre et al. | |
| 2008/0174131 | A1 | 7/2008 | Bouligny et al. | |
| 2008/0202813 | A1 * | 8/2008 | Anthony | 175/52 |
| 2009/0056930 | A1 | 3/2009 | Angelle et al. | |
| 2009/0057032 | A1 | 3/2009 | Angelle et al. | |
| 2009/0252589 | A1 | 10/2009 | Sonneveld et al. | |
| 2010/0059231 | A1 | 3/2010 | Thomas et al. | |
| 2010/0101805 | A1 | 4/2010 | Angelle et al. | |

FOREIGN PATENT DOCUMENTS

| | | | |
|---|---|---|---|
| EP | 2163722 | A1 | 3/2010 |
| WO | 03031766 | A1 | 4/2003 |
| WO | 2007081952 | A1 | 7/2007 |
| WO | 2010048454 | A1 | 4/2010 |

OTHER PUBLICATIONS

Weatherford, "Tubular Running Services: UniSlips", Weatherford.com 2010 (2 pages).

2M-Tek Products, "Flush-Tek S-1000: Flush Mounted Spider", 2m-tek.com Oct. 15, 2009 (3 pages).

European Search Report issued in European Application No. 10154443, mailed Apr. 27, 2010 (7 pages).

International Search Report issued in PCT/US2010/033222, mailed Jan. 26, 2011 (3 pages).

Office Action in corresponding European Application No. 08829182.8, dated Jan. 31, 2011 (5 pages).

Office Action in corresponding European Application No. 1015444.3, dated Apr. 8, 2011 (5 pages).

Office Action issued in corresponding European Application No. 10154443.5 dated Mar. 22, 2013 (5 pages).

2M-Tek Tubular Systems "FLUSH-TEK(TM) Model S-503", Brochure, www.2m-tek.com, May 31, 2009 (2 pages).

Weatherford "Real Results—RMS 2400 Elevator and Flush-Mounted Spider Enhances Safety in Deepwater Gulf of Mexico", weatherford.com, Dec. 3, 2008 (1 page).

International Preliminary Report on Patentability issued in PCT/2008/074639 dated Mar. 2, 2010 (6 pages).

International Preliminary Report on Patentability issued in PCT/US2010/033222 dated Nov. 6, 2012 (5 pages).

Written Opinion of the International Searching Authority issued in PCT/US2010/033222 mailed Jan. 26, 2011 (4 pages).

* cited by examiner

TUBULAR GUIDING AND GRIPPING APPARATUS AND METHOD

CROSS-REFERENCE TO RELATED APPLICATIONS

The present application is a continuation of, and therefore claims benefit under 35 U.S.C. §120 to, U.S. patent application Ser. No. 13/658,503, filed on Oct. 23, 2012, which is a continuation of, and therefore claims benefit under 35 U.S.C. §120 to, U.S patent application Ser. No. 12/771,836, filed on Apr. 30, 2010, having issued as U.S. Pat. No. 8,316,929 on Nov. 27, 2012. This application is also a continuation in part of, and therefore claims benefit under 35 U.S.C. §120 to, U.S. patent application Ser. No. 11/846,169 ("the '169 Application"), filed on Aug. 28, 2007, having issued as U.S. Pat. No. 7,997,333 on Aug. 16, 2011, and is also a continuation in part of, and therefore claims benefit under 35 U.S.C. §120 to, U.S. patent application Ser. No. 12/126,072, filed on May 23, 2008, having issued as U.S. Pat. No. 7,992,634 on Aug. 9, 2011, which is a continuation in part of the '169 Application. These applications are incorporated herein by reference in their entirety.

BACKGROUND OF DISCLOSURE

1. Field of the Disclosure

Embodiments disclosed herein generally relate to methods and apparatus to grip tubular members. More specifically, embodiments disclosed herein relate to an apparatus that is used to guide and grip one or more tubular members, such as oilfield tubular members as the tubular members are disposed downhole.

2. Background Art

In oilfield exploration and production operations, various oilfield tubular members are used to perform important tasks, including, but not limited to, drilling the wellbore and casing a drilled wellbore. For example, a long assembly of drill pipes, known in the industry as a drill string, may be used to rotate a drill bit at a distal end to create the wellbore. Furthermore, after a wellbore has been created, a casing string may be disposed downhole into the wellbore and cemented in place to stabilize, reinforce, or isolate (among other functions) portions of the wellbore. As such, strings of drill pipe and casing may be connected together, such as end-to-end by threaded connections, in which a female "pin" member of a first tubular member is configured to threadably engage a corresponding male "box" member of a second tubular member. Alternatively, a casing string may be made-up of a series of male-male ended casing joints coupled together by female-female couplers. The process by which the threaded connections are assembled is called "making-up" a threaded connection, and the process by which the connections are disassembled is referred to "breaking-out" the threaded connection. As would be understood by one having ordinary skill, individual pieces (or "joints") of oilfield tubular members may come in a variety of weights, diameters, configurations, and lengths.

Referring to FIG. 1, a perspective view is shown of one embodiment of a drilling rig 101 used to run one or more tubular members 111 (e.g., casing, drill pipe, etc.) downhole into a wellbore 113. As shown, the drilling rig 101 includes a frame structure known as a "derrick" 102, from which a traveling block 103 (which may include a top drive) suspends a lifting apparatus 105 (e.g., an elevator or a tubular (e.g., casing) running tool connected to the quill of a top drive) and a gripping apparatus 107 (e.g., slip assembly or "spider") at the rig floor may be used to manipulate (e.g., raise, lower, rotate, hold, etc.) a tubular member 111. The traveling block 103 is a device that is suspended from at or near the top of the derrick 102, in which the traveling block 103 may move up-and-down (i.e., vertically as depicted) to raise and/or lower the tubular member 111. The traveling block 103 may be a simple "pulley-style" block and may have a hook from which objects below (e.g., lifting apparatus 105 and/or top drive) may be suspended. Drilling rig 101 can be a land or offshore rig (e.g., drill ship) without departing from the spirit of the invention.

Additionally, the lifting apparatus 105 may be coupled below the traveling block 103 (and/or a top drive if present) to selectively grab or release a tubular member 111 as the tubular member 111 is to be raised and/or lowered within and from the derrick 102. As such, the top drive may include one or more guiding rails and/or a track disposed adjacent to the top drive, in which the guiding rails or track may be used to support and guide the top drive as the top drive is raised and/or lowered within the derrick. An example of a top drive is disclosed within U.S. Pat. No. 4,449,596, filed on Aug. 3, 1982, and entitled "Drilling of Wells with Top Drive Unit," which is incorporated herein by reference.

Typically, a lifting apparatus 105 includes movable gripping members (e.g., slip assemblies) attached thereto and movable between a retracted (e.g., disengaged) position and an engaged position. In the engaged position, the lifting apparatus 105 supports the tubular member 111 such the tubular member 111 may be lifted and/or lowered, and rotated if so equipped, e.g., by using a lifting apparatus that is a tubular (e.g., casing) running tool connected to the quill of the top drive. In the retracted position, the lifting apparatus 105 may release the tubular member 111 and move away therefrom to allow the tubular member 111 to be engaged with or removed from the lifting apparatus 105 and/or the gripping apparatus 107. For example, the lifting apparatus 105 may release the tubular member 111 after the tubular member 111 is threadably connected to a tubular string 115 supported by the gripping apparatus 107 (e.g., slip assembly or "spider") at the rig floor at the floor of the drilling rig 101.

Further, in an embodiment in which the drilling rig 101 includes a top drive and a tubular running tool, the tubular member 111 may be supported and gripped by the tubular running tool connected to the quill of the top drive. For example, the tubular running tool may include one or more gripping members that may move radially inward and/or radially outward. In such embodiments, these gripping members of a tubular running tool may move radially outward to grip an internal surface of the tubular member 111, such as with an internal gripping device and/or the gripping members of the tubular running tool may move radially inward to grip an external surface of the tubular member 111, such as with an external gripping device, however so equipped.

As such, the gripping apparatus 107 of the drilling rig 101 may be used to support and suspend the tubular string 115, e.g., by gripping, from the drilling rig 101, e.g., supported by the rig floor 109 or by a rotary table thereof. The gripping apparatus 107 may be disposed within the rig floor 109, such as flush with the rig floor 109, or may extend above the rig floor 109, as shown. As such, the gripping apparatus 107 may be used to suspend the tubular string 115, e.g., while one or more tubular members 111 are connected or disconnected from the tubular string 115.

Referring now to FIGS. 2A and 2B, a gripping device 201 that may be included as the lifting apparatus 105 and/or the gripping apparatus 107 of the drilling rig 101 is shown. For example, in addition or in alternative to a gripping device, a lifting apparatus 105 and/or the gripping apparatus 107 may comprise a supporting device may be used that supports one or more tubular members within a drilling rig, such as supporting a tubular string of tubular members suspended from a drilling rig. An example of a supporting device is disclosed within U.S. Pat. No. 6,651,737, filed on Jan. 24, 2001, and entitled "Collar Load Support system and Method," which is incorporated herein by reference.

The illustrated gripping device 201 includes a bowl 203 with a plurality of slip assemblies 205 movably disposed therein. Specifically, the slip assemblies 205 may be connected to a ring 207, in which the ring 207 may be connected to the bowl 203 through an actuator (e.g., actuator rods) 209. Actuator may be actuated, such as electrically actuated and/or fluidly (e.g., hydraulically) actuated, to move up and/or down with respect to the bowl 203, in which the slip assemblies 205 connected to the ring 207 may correspondingly move up and/or down with respect to the bowl 203.

The illustrated slip assemblies 205 are designed to engage and contact the inner tapered surface of the bowl 203 when moving with respect to the bowl 203. Bowl 203 is shown as a continuous surface but may comprise non-continuous surfaces (e.g., a surface adjacent to the rear of each slip assembly 205). Thus, as the slip assemblies 205 move up or down with respect to the bowl 203, the slip assemblies 205 may travel down along an inner surface of the bowl 203. With this movement, an inner surface (e.g., die) of the slip assemblies 205 will grip a tubular member 211 disposed within the gripping device 201. The slip assemblies 205 may have a gripping surface (e.g., teeth) on the inner surface to facilitate the gripping of the tubular member 211. After the tubular member 211 is supported by the gripping device 201, additional tubular members may be connected or disconnected from the tubular member 211.

As shown with respect to FIGS. 2A and 2B, the gripping device 201 may be used to grip tubular members 211 having multiple outer diameters. For example, as shown in FIG. 2A, the slip assemblies 205 may be positioned within the bowl 203 of the gripping device 201 to grip a tubular member 211A having a first diameter D1. As discussed, the slip assemblies 205 may be positioned using the ring 207 that may be vertically moveable, e.g., through the actuator rods 209. FIG. 2B shows gripping device 201, in which the slip assemblies 205 are positioned vertically higher within the bowl 203 with respect to the positioning of the slip assemblies 205 shown in FIG. 2A. As such, this positioning of the slip assemblies 205 in FIG. 2B enables the gripping device 201 to grip another tubular member 211B, in which the tubular member 211B has a second outer diameter D2 larger than the first outer diameter D1 of the tubular member 211A (for example, where D1 and D2 are on a tubular body itself and not a connector portion thereof). Thus, gripping device 201 may grip tubular members 211 having a large range of outer diameters without the need of reconfiguration and/or adding supplemental equipment to the gripping device 201. For example, in one embodiment, the second outer diameter D2 may be at least 145 percent larger (or smaller) than the first outer diameter D1.

A tubular string of tubular members may be heavy, in the magnitude of several hundreds of thousands of pounds. As such, the gripping devices handling these tubular strings, in addition to the drilling rig and other components thereof, must be equipped to handle such weight. Further, tubular members of the tubular string, such as casing, may have a relatively thin wall, in which the tubular members may be crushed or partially deformed if excessive force is applied by the gripping device. Additionally, the weight of the tubular string may be even further magnified, such as when drilling offshore, as the tubular string may need to extend through the water to reach the borehole, which may be in the magnitude of several thousands of feet, if not more. For example, the tubular string may have one or more different tubular members or tubular sections, such as including a section within the tubular string having casing, drill pipe, and/or a landing string, in which each of these sections of the tubular string may have different dimensions (internal diameter and/or external diameter) adding to the overall weight of the tubular string. Adding length to the tubular string only further increases the weight that the gripping devices, drilling rig, and other components thereof must be equipped to handle, an equipping process that may significantly increase the cost of for drilling.

To offset at least some of the weight of the tubular string (which may include a casing string or other tubular string hung from a distal end thereof), floatation modules have been developed that may be connected to or otherwise disposed about (e.g., about the OD of) a tubular member 311. One or more floatation modules 315 may be connected to the tubular member 311, such as by having a hinge formed on one side of the floatation module 315 that enables the floatation module 315 to, for example, clasp around the tubular member 311 from a lateral side thereof. Additionally or alternatively, a floatation module may be attached or applied to the tubular member, such as by applying as a coating or attached via other means, e.g., adhesive, to retain the floatation module stationary with respect to the tubular member. Depicted floatation modules 315 have a generally circular profile (e.g., a cylinder). However, floatation modules 315 may have any shape, such as a rectangular or hexagonal profile or spherical shape, that enables the floatation modules to connect to the tubular member 311.

A floatation module is commonly formed from a buoyant material or buoyant structure, such as having foam (e.g., high density foam) or plastic and/or having a housing with a fluid (e.g., gas) disposed therein for buoyancy. As such, this buoyant material or buoyant structure for the floatation module 315 may be used to offset at least some of the weight of the tubular member 311, e.g., from the drilling rig 101, and thus a tubular string altogether, as the floatation module 315 may be connected to the tubular member 311. A floatation module 315 may be used within the water, e.g., seawater of an offshore drilling operation, and/or a floatation module 315 may be disposed within a wellbore, including the riser, in land or offshore drilling operations. As such, a floatation module 315 may provide a buoyancy force when disposed within water and/or mud of a drilling operation, in which the buoyancy force of the floatation modules 315 may be used to offset at least some of the weight of the tubular string, e.g., from the drilling rig 101.

Further, a floatation module, may be used with a landing string, such as when a landing string is used to dispose (e.g., "land") one or more tubular members, such as casing, within a wellbore in a deep water offshore operation. The landing string, which may exceed tens of thousands of feet in axial length to reach between the sea floor and the drilling rig (e.g., a floating drilling platform or ship), may include one or more floatation modules 315 connected thereto or otherwise disposed about to offset some of the weight of the landing string and the other tubular string (e.g., casing). As such, the floatation modules may relieve, at least a portion, of the stress applied to the landing string, other tubular string, and drilling rig equipment used for the operation.

However, as a floatation module may be formed from a generally buoyant material and/or as a generally buoyant structure (e.g., forming the floatation module with, at least a portion of, foam) a floatation module may lack strength and/ or rigidity, e.g., the floatation module may be easily damaged. For example, a floatation module may be particularly susceptible to damage when assembling and/or disassembling a tubular string of tubular members together and/or disposing (e.g., raising or lowering) the tubular string within and/or through a gripping or supporting device (as discussed herein).

One example may be that, as a floatation module is disposed through a bore of a gripping or supporting device of a drilling rig, one or more of the components of the gripping or supporting device, such as the slip assemblies of the gripping device having a gripping surface (e.g., teeth) or other damage inducing surface or component of a gripping or supporting device, may contact and thus damage (e.g., dislodge) the floatation module. For further example, a gripping surface of a slip assembly (e.g., teeth) contacting a foam portion of a floatation module may damage (e.g., abrade or puncture) the flotation module. As such, damage to a floatation module may be magnified if a tubular member which the floatation module is connected to is not properly aligned within a bore of a gripping or supporting device during movement therethrough. Accordingly, there exists a need to prevent damage to a floatation module connected to a tubular member, as any damage to the floatation module may increase the loads applied to the drilling rig.

SUMMARY OF INVENTION

In one aspect, embodiments disclosed herein relate to an apparatus to guide a tubular member having a floatation module attached thereto. The apparatus includes a bowl forming a bore having a first opening formed at a first side of the bowl, a second opening formed at a second side of the bowl, and a tapered inner wall extending from the first opening to the second opening about a longitudinal axis, a slip assembly movably disposed within the bowl, a first guiding member disposed adjacent to the first opening of the bowl, and a second guiding member disposed adjacent to the second opening of the bowl.

In another aspect, embodiments disclosed herein relate to a system to guide a tubular member having a floatation module attached thereto. The system includes an apparatus having a bore with a longitudinal axis extending therethrough and configured to support a tubular member, the apparatus having a first opening formed at a first side thereof, a second opening formed at a second side thereof, and an inner wall extending from the first opening to the second opening, a first guiding member disposed adjacent to the first opening of the bowl, and a second guiding member disposed adjacent to the second opening of the bowl.

In one aspect, embodiments disclosed herein relate to an apparatus to guide a tubular member. The apparatus includes a bowl finning a bore having a first opening formed at a first side of the bowl, a second opening formed at a second side of the bowl, and a tapered inner wall extending from the first opening to a second opening about a longitudinal axis, a slip assembly movably disposed within the bowl, and a protector movably disposed within the bowl and adjacent to the slip assembly.

In another aspect, embodiments disclosed herein relate to a method to manufacture an apparatus to guide a tubular member having a floatation module attached thereto. The method includes providing a bowl having a bore formed therein, in which the bore is defined about a longitudinal axis with a slip assembly movably disposed within the bowl, disposing a first guiding member adjacent to a first opening of the bore, and disposing a second guiding member adjacent to an opposing second opening of the bore.

In another aspect, embodiments disclosed herein relate to a method to guide a tubular member having a flotation module. The method includes providing an apparatus having a bore formed therein, the bore forming a longitudinal axis, disposing the tubular member, at least partially, within the bore of the apparatus, and guiding the flotation module with at least one guiding member disposed adjacent to the apparatus.

In another aspect, embodiments disclosed herein relate to a method to manufacture an apparatus to guide a tubular member. The method includes providing a bowl having a bore formed therein, the bowl having a first opening formed at a first side of the bowl, a second opening formed at a second side of the bowl, and a tapered inner wall extending from the first opening to a second opening about a longitudinal axis, disposing a slip assembly within the bowl such that the slip assembly is movable with respect to the bowl, and disposing a protector within the bowl such that the protector is adjacent to the slip assembly and is movable with respect to the bowl.

In another aspect, embodiments disclosed herein relate to a method to run a tubular member within a borehole. The method includes providing a bowl having a bore formed therein, the bowl having a first opening formed at a first side of the bowl, a second opening formed at a second side of the bowl, and a tapered inner wall extending from the first opening to a second opening about a longitudinal axis, moving a slip assembly movably disposed within the bowl away from the longitudinal axis of the bowl, and moving a protector disposed adjacent to the slip assembly such that an inner surface of the protector is radially closer to the longitudinal axis of the bowl than an inner surface of the slip assembly.

Other aspects and advantages of the invention will be apparent from the following description and the appended claims.

DETAILED DESCRIPTION

Figure 1:
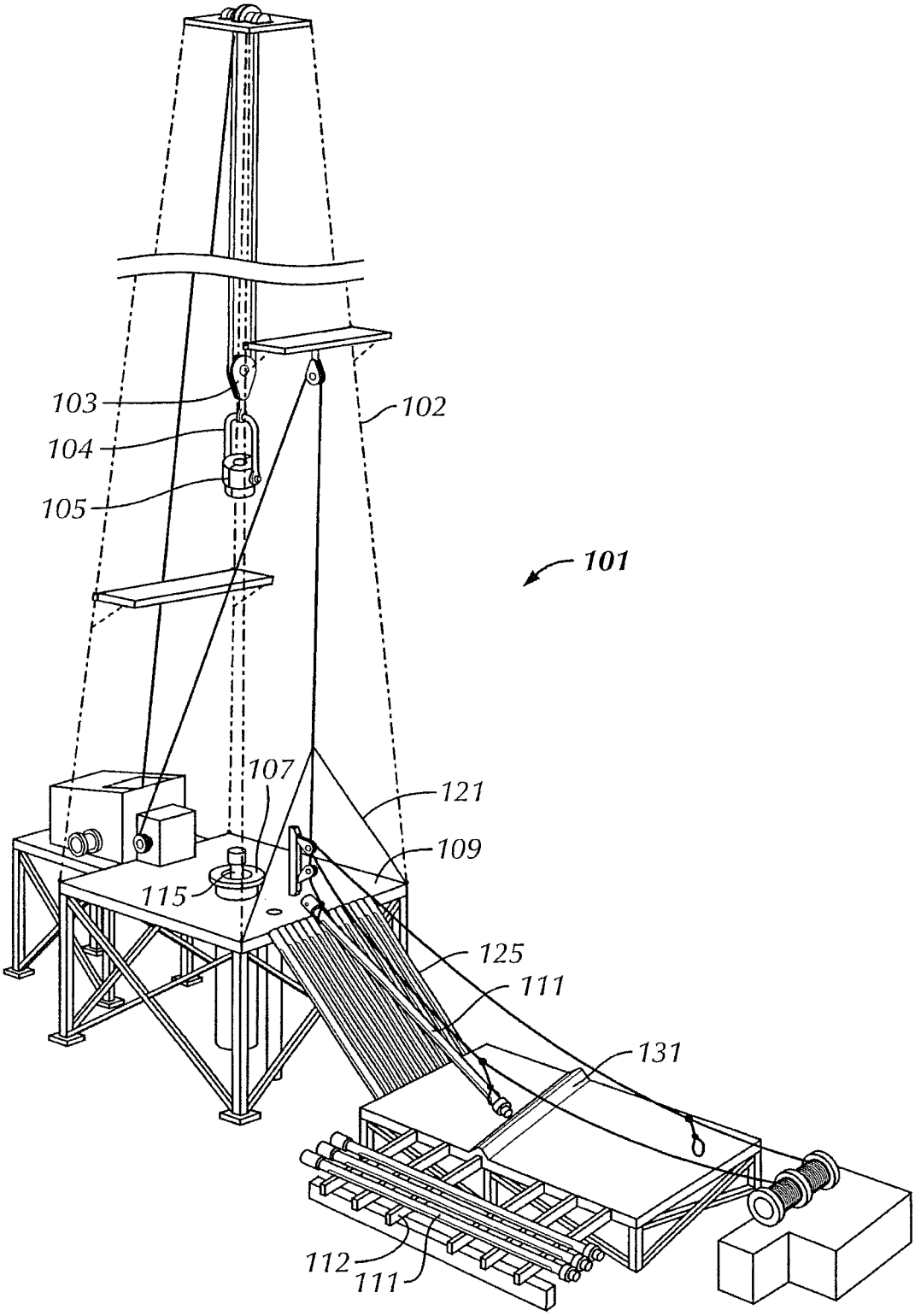
FIG. 1 is a schematic view of a drilling rig.
Figure 2A:
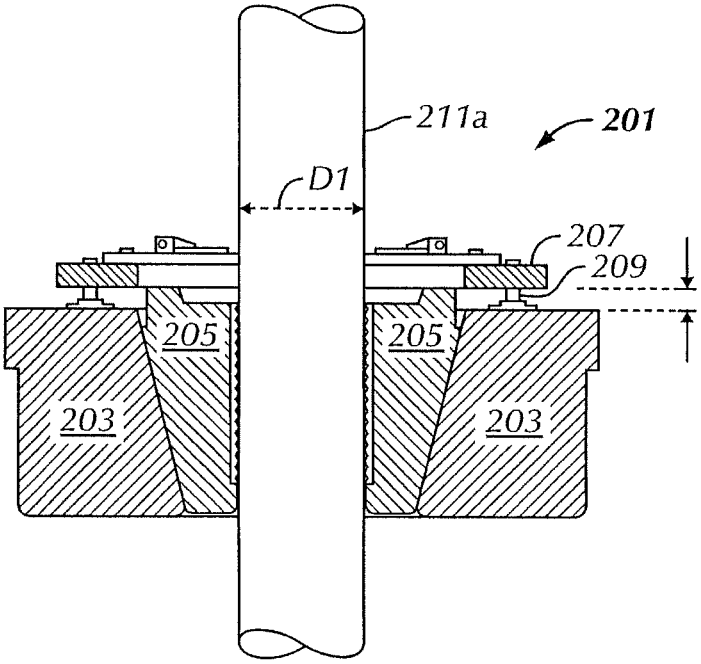
FIGS. 2A and 2B show perspective views of a gripping apparatus disposed within a drilling rig.
Figure 2B:
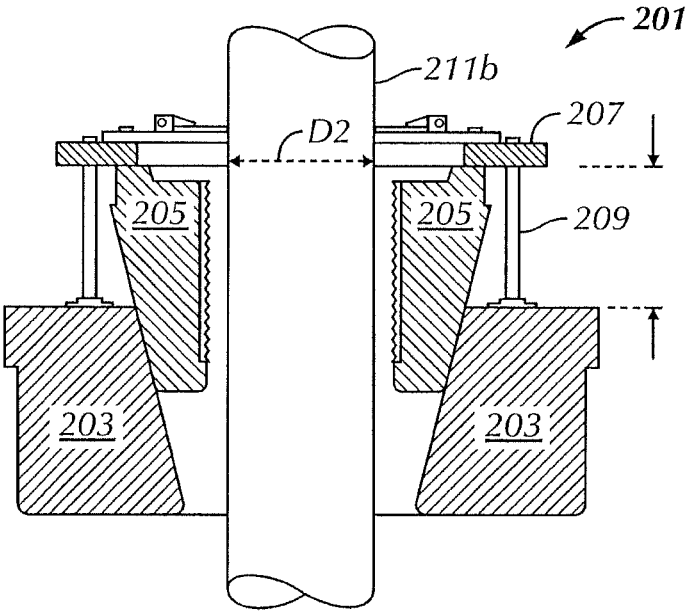
Figure 3:
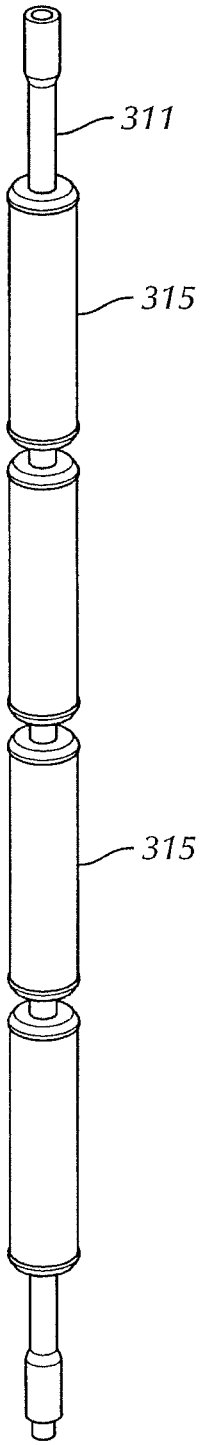
FIG. 3 shows a perspective view of a tubular member having floatation modules connected thereto.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description.

In various aspects disclosed herein, embodiments disclosed herein generally relate to an apparatus that may guide a tubular member, such as guiding a tubular member when assembling a string of tubular members together. For example, embodiments disclosed herein relate to an apparatus that may be used to guide a tubular member. The tubular member, such as in one embodiment, may have one or more floatation modules disposed about and/or connected to the tubular member. The floatation modules may be used to manage the weight of the tubular member, in addition to manage the weight of the string of tubular members altogether. As such, the apparatus may be used to guide the tubular member into and through, for example, a gripping apparatus. In such an embodiment, the apparatus may thereby prevent, at least a portion of, damage from occurring to the floatation modules and/or the tubular member.

For example, if a tubular member having one or more floatation modules connected thereto is misaligned with a gripping apparatus when entering a gripping apparatus, one or more of the floatation modules may contact and be damaged against one or more components of the gripping apparatus (such as by having one or more of the floatation modules contact one or more of the slip assemblies of a gripping apparatus). However, an apparatus in accordance with embodiments disclosed herein may be used to guide and properly align the tubular member when entering a gripping apparatus, thereby preventing, at least a portion, of the damage from occurring to the tubular member and/or the floatation modules connected thereto. Further, in one embodiment the apparatus may be used to grip and support a tubular member, such as when suspending a string of tubular members from a drilling string, independent if the tubular member has a floatation module connected thereto.

Further, in one embodiment the apparatus may be used to allow a tubular member having one or more floatation modules connected thereto to pass through the apparatus, in which the apparatus may then grip and support (e.g., an end of) the tubular member after the one or more floatation modules have passed through the apparatus.

Thus, in one aspect, an apparatus in accordance with embodiments disclosed herein may include a bowl, a plurality of slip assemblies, and one or more guiding members. The bowl may have a bore or opening formed therethrough, and/or the plurality of slip assemblies may be movably connected to the bowl. Further, the apparatus may include one or more guiding members, such as having one or more guiding members disposed adjacent to one opening of the bore (e.g., defined by the bowl) of the apparatus and/or having one or more guiding members disposed adjacent to another opening of the bore. One or more guiding members may be disposed in the bore (e.g., defined by a bowl) of the apparatus, for example between adjacent slip assemblies, without departing from the spirit of the invention. One or more guiding members may be used to guide a tubular member, such as when a tubular member is being disposed within or through the apparatus. For example, the tubular member may have one or more floatation modules disposed thereabout and/or connected thereto, in which one or more of the guiding members may engage a surface of the floatation module to guide the flotation module into and/or through the apparatus. In one embodiment, one or more guiding members may guide a flotation module into and/or through an apparatus (e.g., spider) and also may guide the tubular that the flotation module is connected to through the apparatus (e.g., spider).

In one embodiment, the guiding members may include one or more rollers. A roller may be rotatably connected to the apparatus. As such, as when a roller engages a surface of a floatation module, the roller may rotate and roll against a surface of the floatation module. This movement may enable the roller to guide the floatation module and tubular member into and/or through the apparatus, thereby assisting in preventing, at least a portion, of damage occurring to the floatation module and/or tubular member by the apparatus.

The apparatus may include more than one guiding member. In such embodiments, a plurality of guiding members may be disposed adjacent to one or both ends of the bore (e.g., bowl). As such, the plurality of guiding members may be substantially equally spaced from one another about the longitudinal axis of the bowl. This configuration may enable the guiding members to apply substantially equal pressure to the floatation module and tubular member disposed within the apparatus. Further, the guiding members may be movable with respect to the apparatus, such as movable with respect to the longitudinal axis of the bore (e.g., bowl) of the apparatus. As such, the guiding members may be able to move radially with respect to the longitudinal axis of the bowl. Further, the guiding members may be able to move axially with respect to the longitudinal axis of the bowl.

As used herein, "connected" may refer to not only having two or more elements directly attached to each other, but connected may additionally refer to having two or more elements indirectly attached to each other. For example, as discussed more below, an apparatus in accordance with embodiments disclosed herein may have a guiding member connected to a bowl of the apparatus. As such, it should be understood that the present disclosure contemplates not only having the guiding member directly attached to the bowl, but the present disclosure additionally contemplates other structures and/or arrangements for the apparatus, such as by having a structure or member disposed between the guiding member and the bowl, in which the guiding member and the bowl are connected to each other through the other structure or member.

Figure 4:
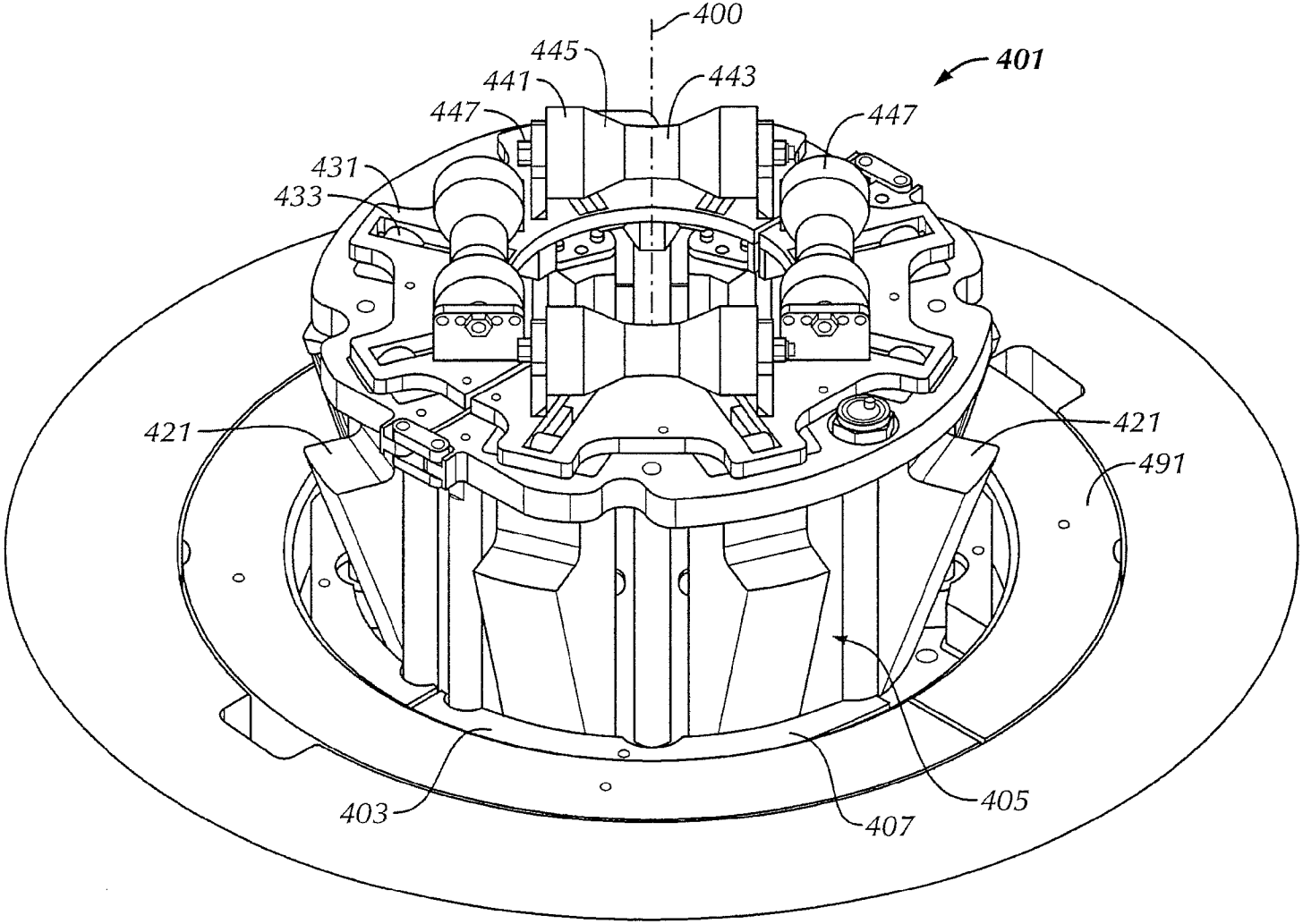
FIG. 4 shows a perspective view of a guiding apparatus in accordance with embodiments disclosed herein.

Referring now to FIG. 4, a perspective view of an apparatus 401 to guide a tubular member in accordance with embodiments disclosed herein is shown. In this embodiment, the apparatus 401 is disposed within a surface 491, such as within a rotary table 109 of a drilling rig 101 (e.g., shown in FIG. 1). Particularly, as shown, the apparatus 401 may be disposed within an adapter ring, in which the adapter ring may be disposed, and thus suspended, within a rotary table of a drilling rig. Those having ordinary skill in the art, however, will appreciate that the present disclosure is not so limited, as the apparatus may, in other embodiments, be disposed above or on the surface without departing from the scope of the present disclosure.

Guiding apparatus 401, which may be a spider as illustrated or an elevator, e.g., with the attachment of lifting bail or link eyes, includes a bowl 403 defining a bore 405 therein. The bore 405 may be formed about an axis 400 extending longitudinally through the apparatus 401. Specifically, the bowl 403 may be formed such that a top opening 407 of the bore 405 is formed at a top side of the bowl 403, and a bottom opening of the bore 405 is formed at the bottom side of the bowl (depicted in FIG. 5). Further, the depicted bowl 403 has an inner wall that extends between the top opening 407 of the bowl 403 to the bottom opening. Although the bowl is shown as being a continuous surface, the term bowl may also refer to a plurality of discrete surfaces without departing from the scope of the present disclosure. The depicted inner wall of the bowl 403 is skewed at an angle (e.g., tapered) with respect to the axis 400. For example, the bowl 403 may have a smooth, non-stepped profile, tapered inner wall, in which the bowl 403 may be used to enable the apparatus 401 to grip a range of tubular members having different dimensions (e.g., different outer diameters), with the slip assemblies moving along the bowl 403. However, those having ordinary skill in the art will appreciate that the present disclosure is not so limited, as other shapes and profiles, such as a stepped (e.g., "rapid advance") profile, may be used for the inner wall of the bowl without departing from the scope of the present disclosure.

The depicted apparatus 401 further includes a plurality of slip assemblies 421, in which the slip assemblies 421 are movable with respect to the bowl 403 (e.g., in-and-out of the bowl 403), such as by having the slip assemblies 421 movably connected to the bowl 403. Specifically, the depicted slip assemblies 421 are movable in a radial direction with respect to the axis 400 as well as being movable in a longitudinal direction along the axis 400. For example, by having the slip assemblies 421 movably connected to the bowl 403, the slip assemblies 421 may be able to "slide" towards and/or away from the axis 400, e.g., move along the inner wall of the bowl 403. As such, the slip assemblies 421 may be used to grip a tubular member, such as gripping an outer surface of a tubular member received within the apparatus 401. Slip assemblies 421 may be restricted from lateral movement in the bore (e.g., bowl), for example, while still allowing for movement towards and/or away from axis 400 (e.g., radial movement relative to axis 400 of the bore).

As shown, the slip assemblies 421 may be movably connected to a support ring 431. Support ring may be a "timing ring", e.g., as discussed in the '169 application and the '072 application. For example, by using a slide mechanism 433, the slip assemblies 421 may be able to move in the radial direction with respect to the axis 400, in addition to the longitudinal direction along the axis 400, such as when the support ring 431 moves in the longitudinal direction. However, those having ordinary skill in the art will appreciate that other mechanisms or connections may be used to movably connect the slip assemblies to a support ring and/or the bowl. For example, in accordance with embodiments disclosed herein, a pin-and-link mechanism may be used to movably connect the slip assemblies to the support ring. As such, the present disclosure contemplates other structures and/or arrangements for the apparatus without departing from the scope of the present disclosure.

Apparatus 401 may include one or more guiding members 441, in which the guiding member(s) 441 may be disposed adjacent to one or more ends or openings of the bore (e.g., defined by bowl 403), slip assemblies 421, and/or support ring 431. In FIG. 4, the guiding member(s) 441 are depicted as connected to the support ring 431, in which the guiding member(s) 441 may be disposed adjacent to the top side 407 of the bowl 403, e.g., when the slip assemblies 421 are received within the bowl 403. The guiding member(s) 441 may be substantially equally spaced (e.g., laterally and/or circumferentially) from one another about the axis 400, e.g., three or more guiding member(s) 441 substantially equally spaced from one another. This arrangement may enable the guiding member(s) 441 to provide guidance from multiple directions for a tubular member received within the apparatus 401 (discussed more below). For example, the guiding member(s) may guide a tubular member when being received into and/or being extracted from the apparatus, and/or the guiding member(s) may guide a lateral movement of the tubular member with respect to the apparatus. However, those having ordinary skill in the art will appreciate that the present disclosure is not so limited, as guiding member(s) may be disposed at other locations (e.g., within the bore of the bowl 403 or on the slip assemblies 421) and/or connected to other components, such as by having guiding member(s) connected to the drilling rig rather than connected to the apparatus itself (e.g., support ring as discussed above), without departing from the scope of the present disclosure.

As discussed above, the guiding member(s) 441 may be used to guide a tubular member into the apparatus 401. As such, the guiding member(s) 441 may be disposed adjacent to the bore of the apparatus 401 having axis 400 such that as a tubular member is received within the apparatus 401, the guiding member(s) 441 may engage a surface of the tubular member, or in other embodiments, a surface of a component connected to the tubular member such as a flotation module, to guide the tubular member into, out of, and/or through the apparatus 401. For example, in an embodiment in which a tubular member has a floatation module disposed thereabout and/or connected thereto, the guiding member(s) 441 may engage a surface of the floatation module to guide the tubular member into, out of, and/or through the apparatus 401. Though not particularly stated, those having ordinary skill in the art will appreciate that the present disclosure contemplates use with guiding a tubular member into, out of, through, and/or any other movement with an apparatus in accordance with embodiments disclosed herein.

As such, in one embodiment, the guiding member(s) 441 comprise one or more rollers, though those having ordinary skill in the art will appreciate any type of guiding member may be used to guide a tubular member within an apparatus in accordance with embodiments disclosed herein. For example, a guiding member may include a conveyor belt (not shown), such as a top and/or bottom set of three or more conveyor belts disposed about the bore of the apparatus 401. Rollers may be able to rotate, such as by having the roller rotatably connected (e.g., by bearing) to the support ring 431, as shown in FIG. 4. In such an embodiment, the rollers may be able to rotate about an axis thereof, in which the axis of rotation for the rollers may be disposed transverse with respect to the axis 400 of the apparatus 401. As such, the axis of rotation for one or more of the rollers may be skewed with respect to the axis 400 of the apparatus 401. Guiding member(s) (e.g., roller) may be mounted to the apparatus 401 in any manner and/or means without departing from the spirit of the disclosure. The roller(s) may then be used to "roll" against a surface of, for example, a floatation module disposed about a tubular member. This engagement with the floatation module by the guiding member may be used to prevent, at least a portion of, damage from occurring to the floatation module and/or tubular member, e.g., from contact with the slip assemblies.

As shown in FIG. 4, the guiding member 441 may have multiple sections and/or outer profiles, such as a middle section 443 disposed between two side sections 445 in the depicted roller 441. As such, in one or more embodiments, the middle section 443 may have a diameter that is smaller than a diameter of one or both of the two side sections 445. Guiding member 441 may comprise one or more frustoconical sections, for example, two frustoconical sections wherein the tapered ends are adjacent and/or abut. This configuration may provide the guiding member with an outer surface that compliments the outer surface of a floatation module and/or tubular member for desirable engagement with the floatation module and/or tubular member.

Those having ordinary skill in the art, however, will appreciate that the present disclosure is not so limited, as the guiding member of the present disclosure may have multiple sizes, shapes, arrangements, and/or configurations. In one embodiment, one or more of the guiding member(s) may have a convex or a concave outer surface, e.g., in which the convex or concave surface is used to engage with the outer surface of a floatation module and/or tubular member. Alternatively, in another embodiment, one or more of the guiding member(s) may have a substantially cylindrical outer surface. Further, in yet another embodiment, one or more of the guiding member(s) may have a low coefficient outer surface, in which the low coefficient surface may enable a floatation module and/or tubular member to "slide" against the surface of the guiding member(s). Furthermore, additionally or alternatively to a roller, one or more of the guiding member(s) may have a sloped surface, such as by having a surface that is sloped towards the axis of the apparatus (e.g., to form a generally convergent surface, for example, converging towards an opening of the bore) to facilitate guiding a tubular member into the apparatus. Furthermore still, in one embodiment, one or more of the guiding member(s) may collectively comprise a ring, or at least a portion of a ring, in which the guiding member(s) may be able to move between multiple radial positions with respect to the axis of the apparatus. For example, in one embodiment, one or more guiding members may be disposed about an axis of the apparatus such that the guiding member(s) form a circular, or semi-circular, arrangement with respect to the axis of the apparatus (e.g., laterally adjacent). In such an arrangement, one or more of the guiding members may be movable with respect to the axis of the apparatus, such as movable radially (e.g., only radially) with respect to the axis of the apparatus. As such, multiple sizes, shapes, arrangements, and configurations are contemplated for one or more guiding member(s) in accordance with the present disclosure.

One or more of the guiding member(s) may be connected to the apparatus such that the guiding member(s) may move (e.g., be actuated) in the radial direction (e.g., at least the radial direction) with respect to the axis of the apparatus. In such an embodiment, the guiding member(s) may be movable between multiple radial positions with respect to the axis of the apparatus. Such guiding member(s) may be selectively locked into one or more of the radial positions, as desired. For example, as shown in FIG. 4, the guiding member(s) 441 may be connected to the apparatus 401 such that the guiding member(s) 441 are moveable between multiple radial positions with respect to the axis 400 of the apparatus 401. Specifically, in this depicted embodiment, the guiding member 441 is connected to the support ring 431 using a removable connector 447 (e.g., a bolt or pin movable into multiple holes or a slot in a bracket), in which connector 447 may be removed to enable the guiding member 441 to adjust the radial position of the guiding member 441 with respect to the axis 400. As such, the present disclosure contemplates other structures and/or arrangements for the guiding member(s) without departing from the scope of the present disclosure.

Figure 12A:
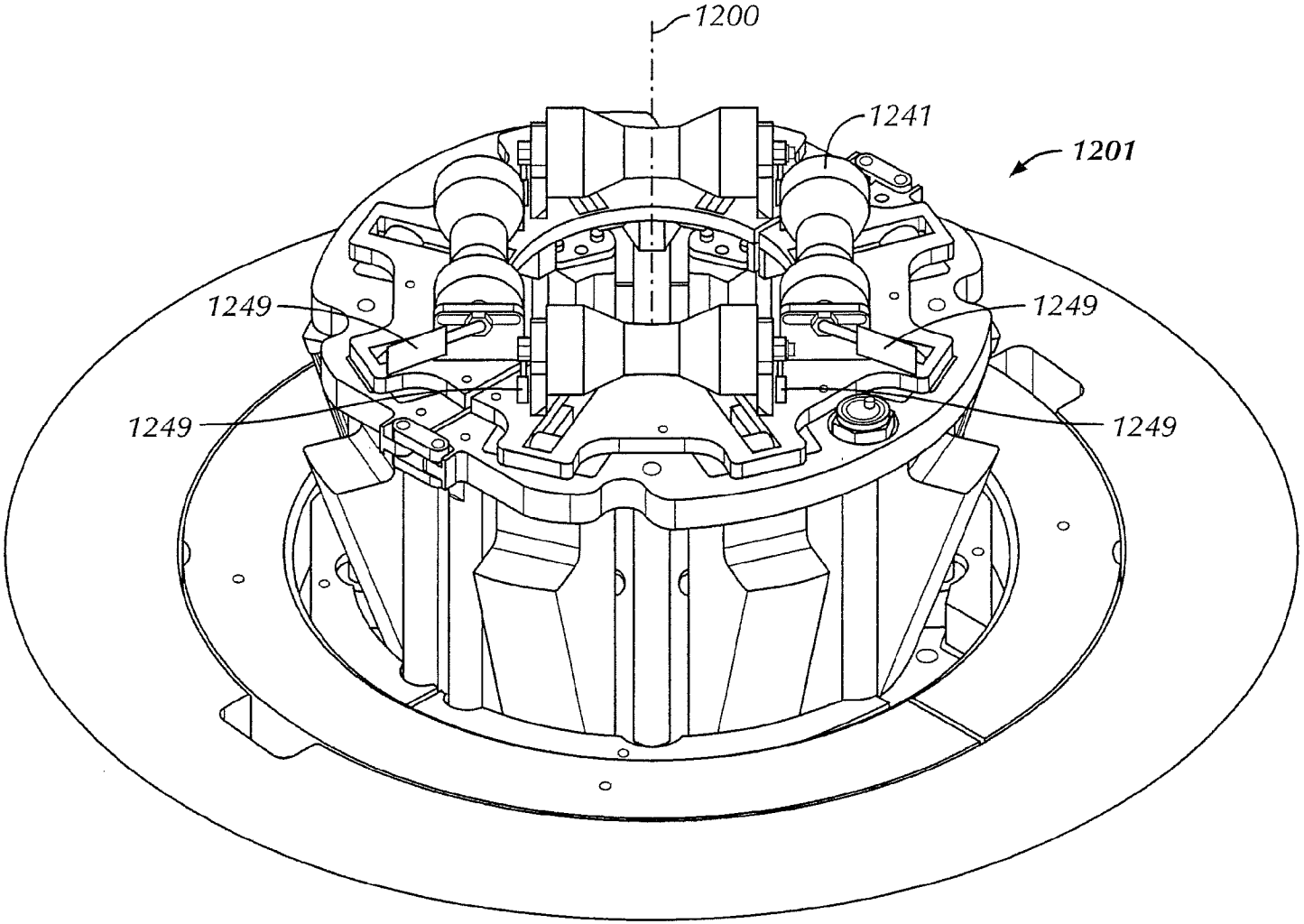
FIGS. 12A and 12B show perspective views of a guiding apparatus in accordance with embodiments disclosed herein.
Figure 12B:
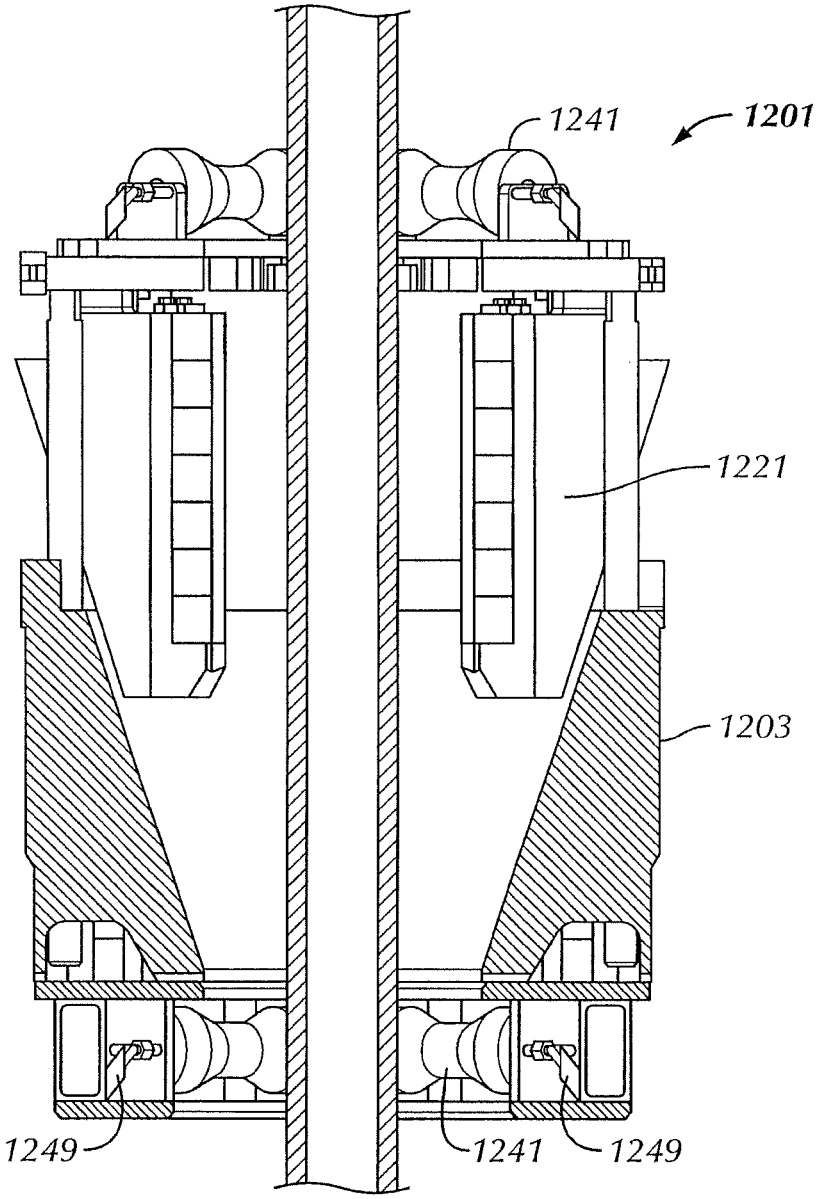

Guiding member(s) may be driven by an actuator, e.g., driven towards and/or away from the bore of the apparatus. An actuator may be mounted to a guiding member(s) via linkage or other ways known in the art. An upper and/or a lower set of laterally adjacent guiding members may comprise an actuator, to drive guide member(s) towards and/or away from the bore of the apparatus. As such, an actuator may have a sensor and/or a controller coupled thereto and/or with each other, in which a sensor may be able to communicate the position of a guiding member and the controller may be able to send signals to control the actuator, thereby enabling the actuator to move the guiding member to a desired position. Referring now to FIGS. 12A and 12B, perspective views of an apparatus 1201 to guide a tubular member in accordance with embodiments disclosed herein is shown. In this embodiment, the apparatus 1201 includes a plurality of guiding members 1241, in which the apparatus 1201 includes one or more actuators 1249 operatively coupled to a guiding member(s) 1241 to move the guiding member(s) 1241. For example, an actuator 1249 may be coupled to each guiding member 1241, in which the actuator may be used to move the guiding member 1241 toward and/or away from the axis 1200 of the apparatus 1201. In the embodiment in FIGS. 12A and 12B, one or more of the guiding members 1241 may be slidably mounted within a slot at an end thereof, in which the actuator 1249 may be attached to the end of the guiding members 1241 to move the guiding members. As such, as the actuators 1249 are actuated, the actuators 1249 may move the guiding members 1241 towards and/or away from the axis 1200. Further, in this embodiment, one or more of the actuators 1249 may be attached adjacent the top of the apparatus 1201 when coupled to the guiding members 1241. Further, as shown in FIG. 12B, guiding members 1241 disposed at the lower end of the apparatus may also include an actuator 1249 to move guiding members (e.g., move towards and/or away from the axis 1200), such as similar to the actuator(s) shown in FIG. 12A. An actuator used in accordance with one or more embodiments disclosed herein may be a hydraulic, pneumatic, electric, and/or any other actuator known in the art. An actuator may be remotely controlled. Further, those having ordinary skill in the art will appreciate that other arrangements for an actuator to move a guiding member of an apparatus in accordance with embodiments disclosed herein may be used without departing from the scope of the present disclosure.

In one embodiment, guiding member(s) having actuators connected thereto may be controlled, such as controlled by a processor or other control system, to dispose one or more of the actuated guiding members to a desired location (e.g., a desired distance from the axis of the bore of the apparatus or from the surface of a tubular disposed in the bore the apparatus). For example, guiding members (e.g., laterally adjacent guiding members) may be actuated, such as by a processor/computer or by an operator, to move and dispose the guiding members to a substantially uniform radial distance relative to the axis of the bore of the tool, such as shown in FIGS. 12A and 12B. Further, in one embodiment, a plurality of guiding members may be actuated (e.g., a guiding surface of the guiding members may be actuated) to a radial distance relative to the axis of the bore that is greater than the largest radial distance (e.g., outer diameter) of a flotation module mounted to a tubular member being run into the apparatus, but may also be less than the smallest radial distance of the apparatus, such as the radial distance of the gripping surface of the slip assemblies when the slip assemblies are in a retracted (thereby no longer gripping the tubular member) position or other position with the apparatus. In one embodiment, one set (e.g., one or more guiding members of a laterally adjacent set of guiding members or one of an upper and a lower set of laterally adjacent guiding members) of guiding members may be actuated and another set may be non-actuated, for example, three or more actuated guiding members interspersed with three or more non-actuated guiding members. Further, in one embodiment, a plurality of guiding members may be actuated (e.g., via a controller) to move to a radial distance relative to the axis of the bore that is less than the radial distance of the gripping surface of the slip assemblies (e.g., in a retracted position). The plurality of guiding members may be actuated (e.g., via a controller) to move radially away from the axis of the bore (e.g., only) to allow the slip assemblies (e.g., the gripping surface of the slip assemblies) to be a radial distance relative to the axis of the bore that is less than the radial distance of the plurality of guiding members, thereby enabling a tubular member to be gripped by the slip assemblies when desired.

In one embodiment, in an inward radial position, the guiding member(s) may be extendable further radially inward than the gripping portion of the slip assemblies with respect to the axis of the apparatus. In an outward radial position, the guiding member(s) may be extendable further radially outward than the gripping portion of the slip assemblies with respect to the axis of the apparatus. Further, those having ordinary skill in the art will appreciate that, though one or more guiding members may have an actuator attached thereto, in other embodiments without actuators attached thereto, guiding members may be movable, such as movable between an inward radial position and an outward radial position. Further, in accordance with one or more embodiments disclosed herein, one or more guiding members may not be movable, such as with respect to the axis of the apparatus. In such an embodiment, the guiding member(s) may be disposed in a desired radial position, such as by having the guiding member(s) disposed in an inward radial position. As such, those having ordinary skill in the art will appreciate that the present disclosure contemplates multiple orientation and arrangements for the guiding members, as the guiding members may be movable, non-movable, and/or may include one or more actuators.

Figure 5:
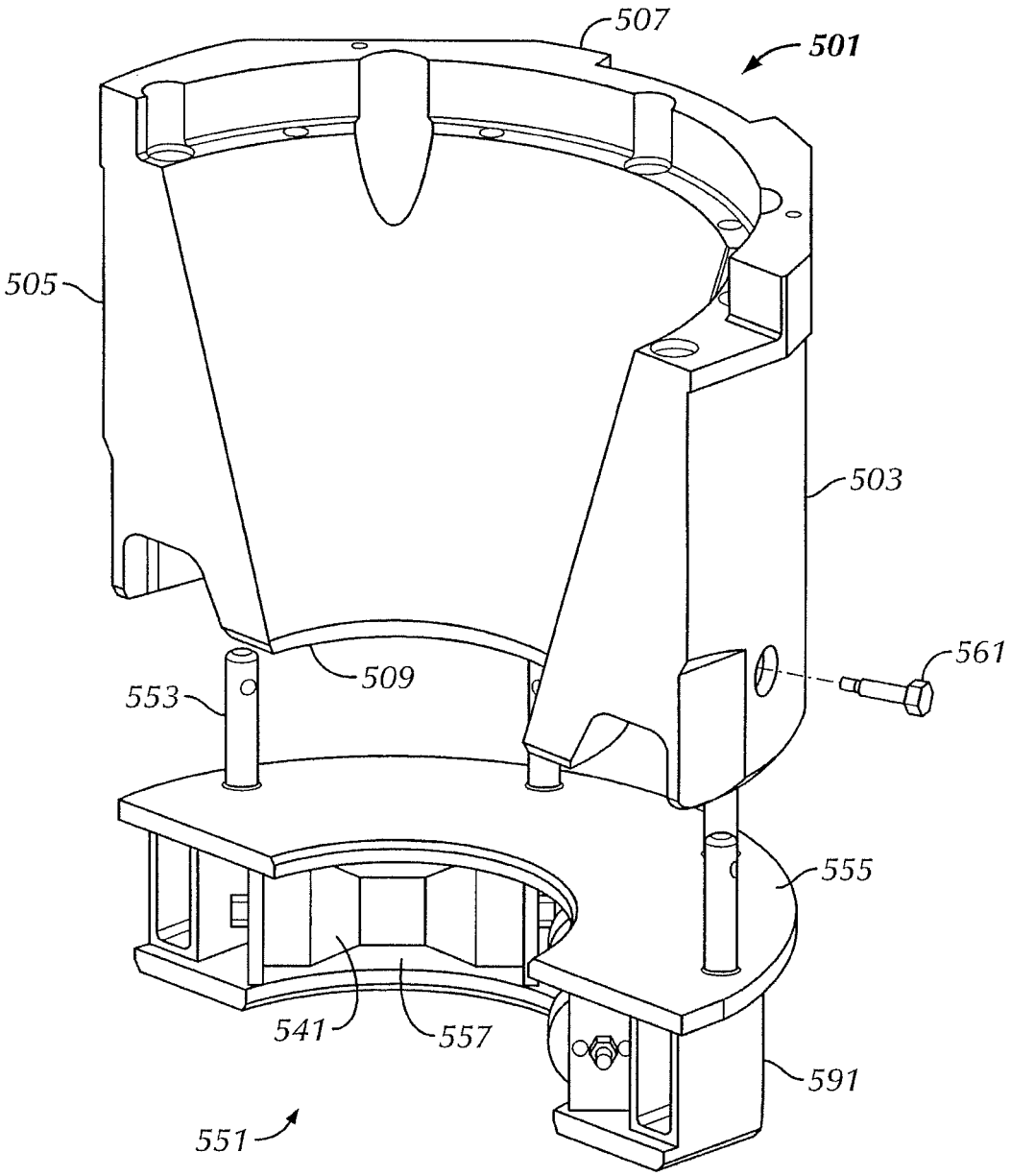
FIG. 5 shows a partial exploded view of a guiding apparatus in accordance with embodiments disclosed herein.

Referring now to FIG. 5, a partial exploded view of an apparatus 501 to guide a tubular member in accordance with embodiments disclosed herein is shown. Specifically, in this embodiment, the apparatus 501 is shown partial and exploded to depict the bore formed in the bowl 503 in more detail. As such, and as discussed above, the apparatus 501 includes a bore formed by illustrated section of bowl 503, in which the bore has a first (e.g., top) opening 507 formed at one (e.g., a top) side of the bowl 503 and a second, opposing (e.g., bottom) opening 509 formed at the other (e.g., bottom) side of the bore defined by bowl 503. Further, the bowl 503 has an inner wall 505 that extends between the top opening 507 of the bowl 503 to the bottom opening 509 of the bowl. The inner wall 505 is illustrated as tapered with respect to the axis of the bowl and shown as a circumferentially continuous inner surface but may comprise non-continuous surfaces as noted previously.

The apparatus 501 may include one or more guiding members 541, in which, as discussed above, the guiding member(s) 541 may be disposed adjacent to one or more sides of the bowl 503. As shown in FIG. 5, the guiding member(s) 541 are disposed adjacent to the bottom opening 509 of the bottom side of the bowl 503. Apparatus 501 may include a plate assembly 551, in which the plate assembly 551 may have the guiding member(s) 541 connected thereto and the plate assembly 551 may connect to the bowl 503. Although shown adjacent to the bottom opening 509 of bowl 503, additionally or alternatively plate assembly 551 can be disposed adjacent to top opening 507 of the bowl 503 or anywhere else desired. The guiding member(s) 541 may be connected to the plate assembly 551 such that the guiding member(s) 541, or at least a portion thereof, may extend (or may be extendable) further radially inward with respect to an axis of the bore of the tool than any component of the plate assembly 551, such as discussed above. This may enable the guiding member(s) 541 to engage a surface of a floatation module and/or a tubular member when being disposed within the apparatus 501.

A plate assembly 551 may include one or more plates included therein, if desired, to connect to the guiding member(s) 541. For example, in this embodiment, the plate assembly 551 includes a first plate 555 and a second plate 557 connected to each other using one or more struts 591. The first plate 555 and the second plate 557 may be disposed substantially parallel with respect to each other, and a strut may be connected between the first plate 555 and the second plate 557 such that a gap is formed between the first plate 555 and the second plate 557 of the plate assembly 551. As such, this arrangement may enable one or more guiding member(s) 541 to be disposed between the first plate 555 and the second plate 557 of the plate assembly 551, such as disposed within gaps formed within the plate assembly 551. However, those having ordinary skill in the art will appreciate that the present disclosure is not so limited, as other structures and/or arrangements may be used for the apparatus without departing from the scope of the present disclosure, such as a plate assembly having only one plate or more than two plates, or by not including a plate assembly at all and having the guiding member(s) connect to the bowl of the apparatus.

Further, the plate assembly 551 may removably connect to the bowl 503 of the apparatus 501, if desired. As shown in FIG. 5, the plate assembly 551 may removably connect to the bowl 503 using a bolt or pin 561 that removably attaches to a shaft 553 of the plate assembly 551 through the bowl 503. However, those having ordinary skill in the art will appreciate that other mechanisms, devices, structures, and/or arrangements may be used to removably connect the plate assembly to the bowl of the apparatus, such as by latching a surface of the plate assembly to a surface of the bowl, without departing from the scope of the present disclosure.

Furthermore, one or more components of an apparatus in accordance with embodiments disclosed herein may be formed into one or more sections or unitary. For example, in select embodiments, the bowl may be formed into more than one section. Specifically, as shown in FIG. 5, the bowl 503 may be formed into two sections (though only one section is shown) such that the sections form two substantially similar halves. Similarly, the support ring may be formed into more than one section and the plate assembly may be formed into more than one section, as desired. Forming the apparatus into more than one section may facilitate installation of the apparatus. For example, the size and weight of the components of the gripping apparatus may be reduced when portioned into sections. In such embodiments, the sections of the bowl, support ring, and any other components of the apparatus, may be formed such that the sections are formed along a plane intersecting with the axis of the apparatus. However, those having ordinary skill in the art will appreciate that the present disclosure is not so limited, as the sections may be formed for the apparatus may be formed along any other lines, if the sections are formed for the apparatus at all.

Figure 6A:
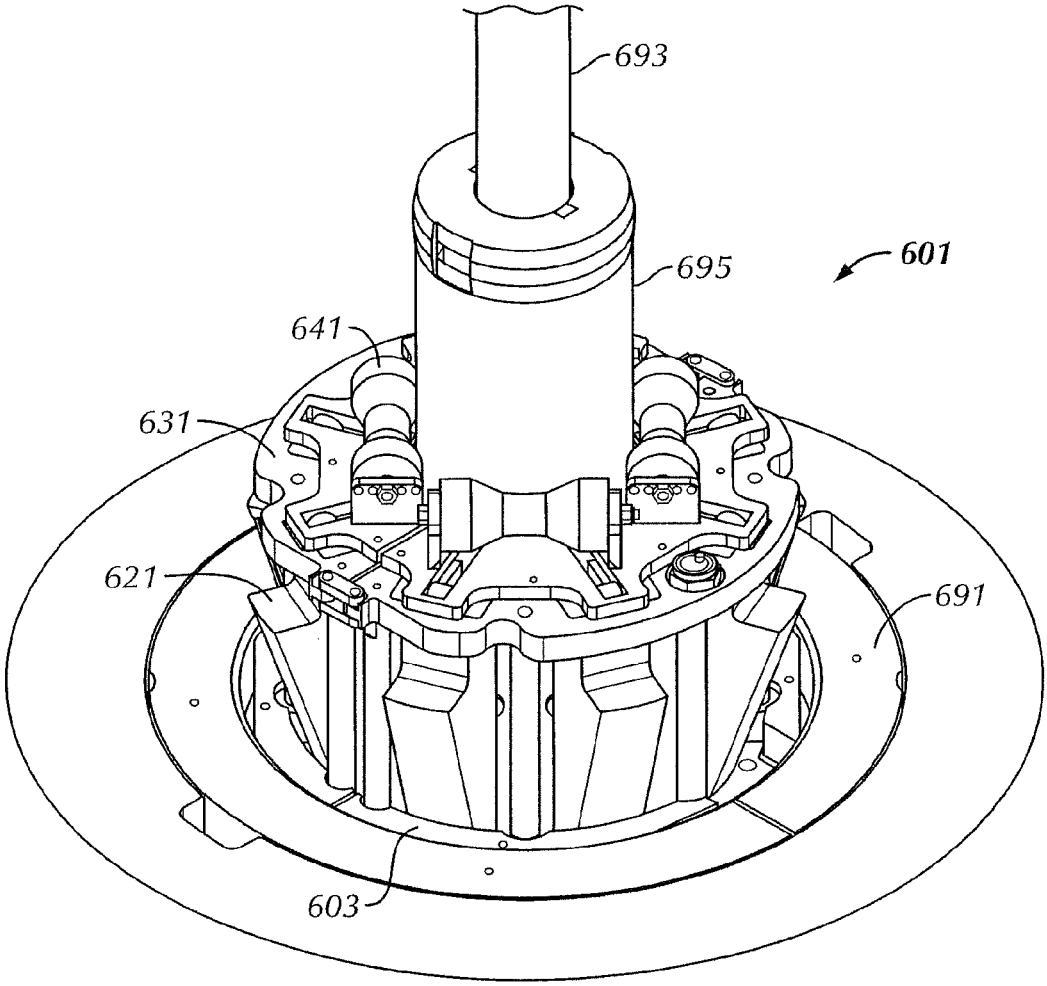
FIGS. 6A-6D show multiple views of an apparatus in accordance with embodiments disclosed herein.
Figure 6B:
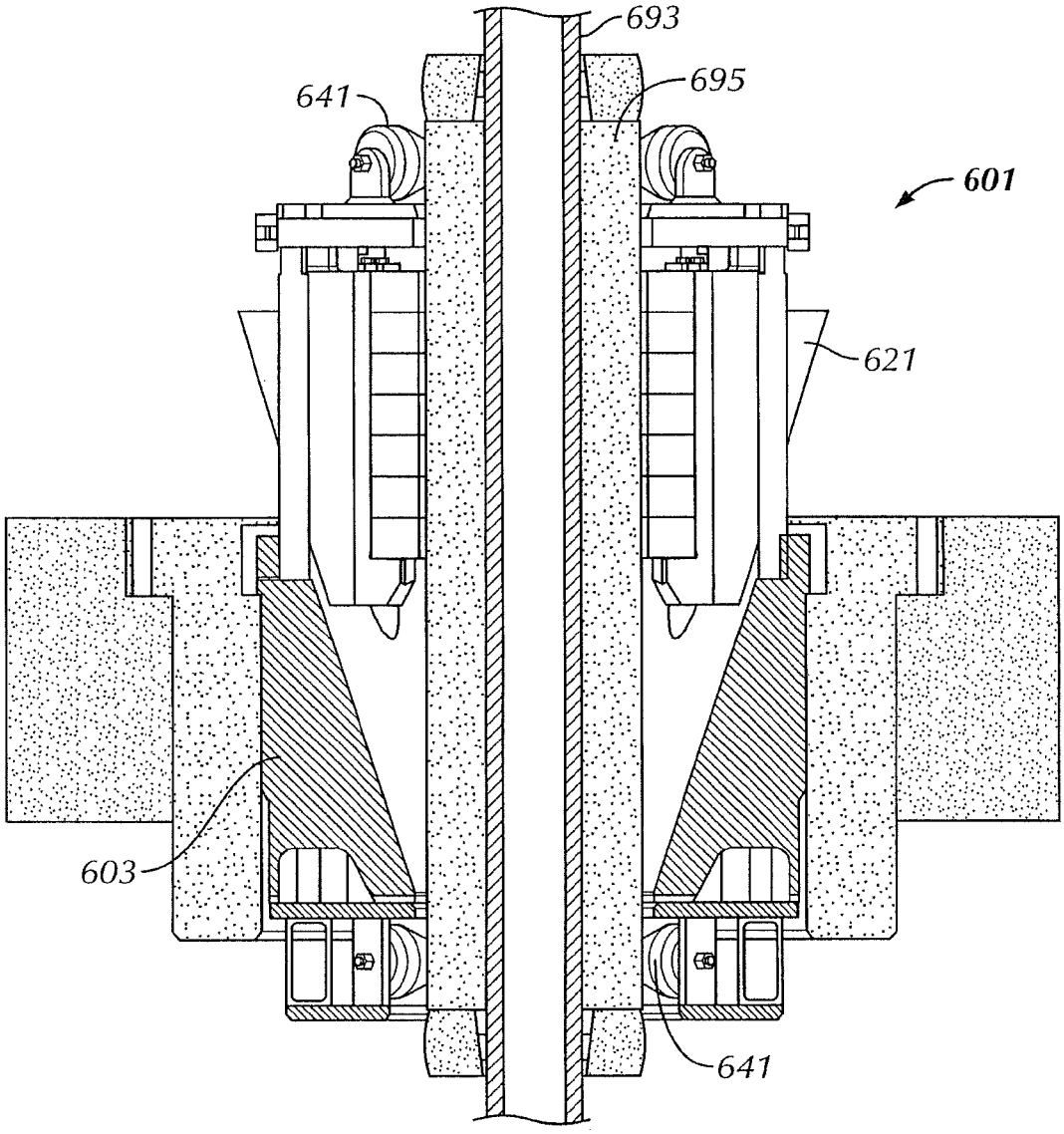
Figure 6C:
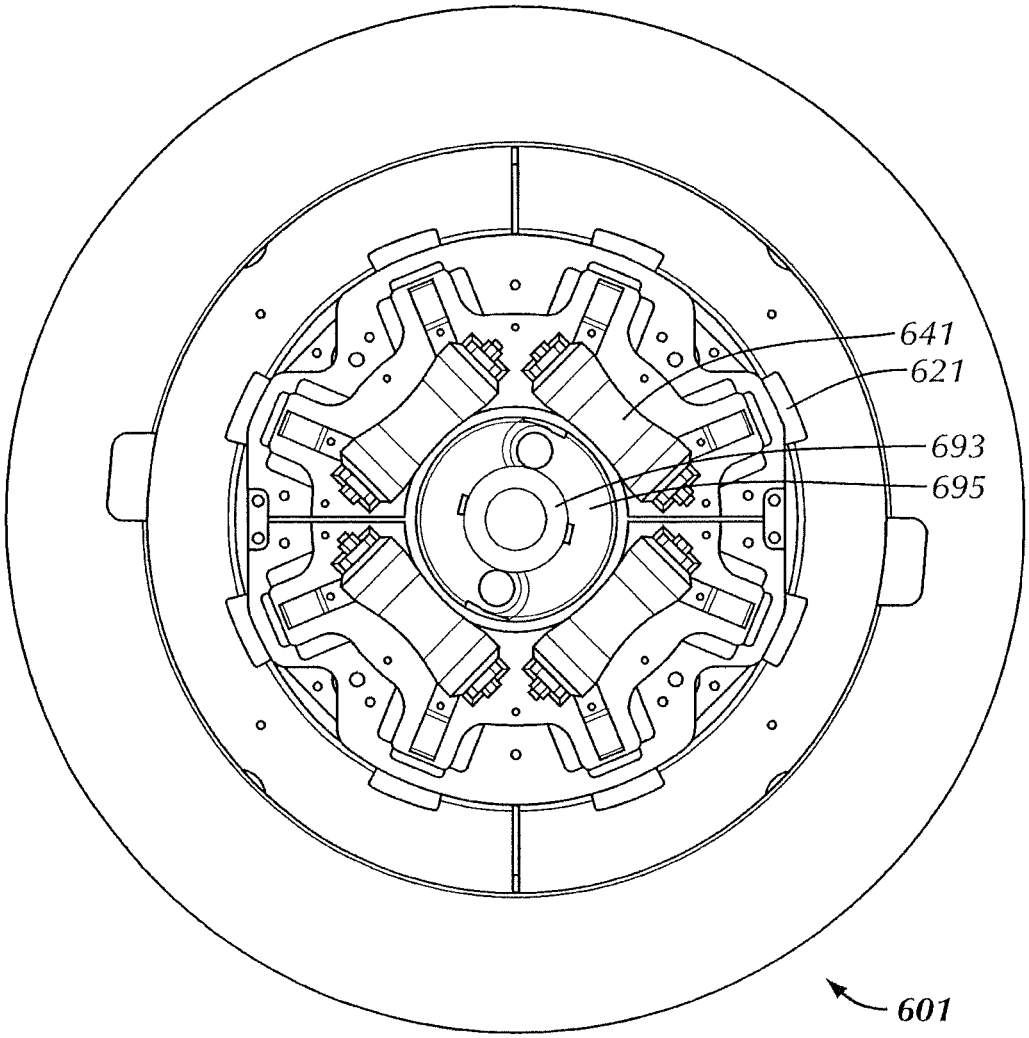
Figure 6D:
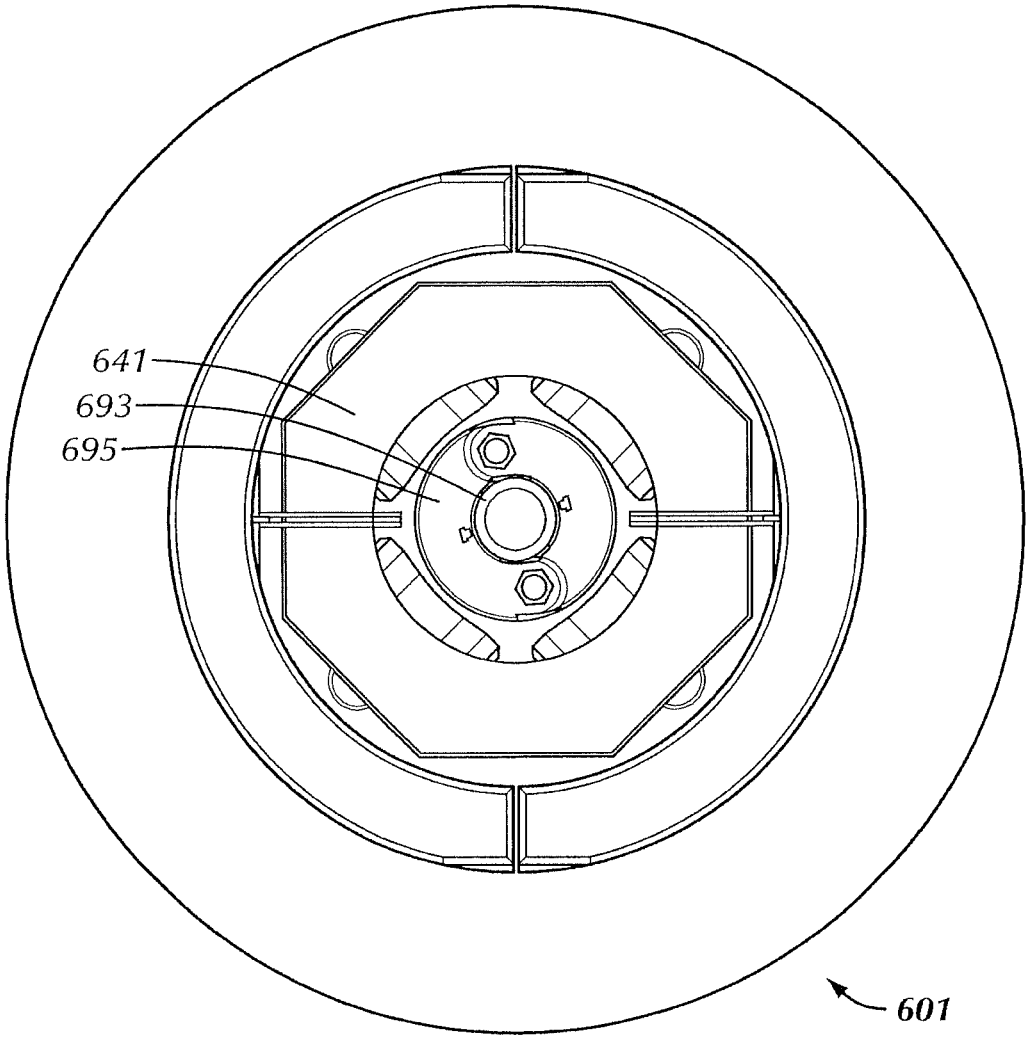

Referring now to FIGS. 6A-6D, multiple views of an apparatus 601 guiding a tubular member 693 in accordance with embodiments disclosed herein is shown. FIG. 6A shows a top perspective view of the apparatus 601 guiding a tubular member 693, FIG. 6B shows a cross-sectional view of the apparatus 601 guiding a tubular member 693, FIG. 6C shows an above view of the apparatus 601 guiding a tubular member 693, and FIG. 6D shows a below view of the apparatus 601 guiding a tubular member 693.

As with the embodiment shown in FIG. 4, the apparatus 601 shown here in FIG. 6 may be disposed within a surface 691, such as disposed within an adapter ring included within a rotary table of a drilling rig. Further, in this embodiment, the tubular member 693 has a floatation module 695 disposed about the tubular member 693. The floatation module 695 may be disposed about and connected to the tubular member 693. A floatation module in accordance with embodiments disclosed herein is disclosed within U.S. Pat. No. 7,383,885, filed on Sep. 22, 2004, and entitled "Floatation Module and Method," which is incorporated herein by reference. As such, floatation modules (e.g., positive buoyancy modules) having other shapes, sizes, structures, and/or arrangements may be used in accordance with embodiments disclosed herein, such as by having a lower density material, with respect to the tubular member and/or the fluid the buoyancy module is disposed in, applied to and/or disposed about an outer surface of the tubular member.

Further, the apparatus 601 may include a bowl 603 and a plurality of slip assemblies 621, in addition to a support ring 631 and one or more guiding member(s) 641. The guiding member(s) 641 may be substantially equally spaced from one another about the longitudinal axis of the bowl 603. As such, and as described above, the guiding member(s) 641 may be used to guide the tubular member 693 when the tubular member 693 is being disposed adjacent to and/or within the apparatus 601. For example, as the floatation module 695 is disposed about and connected to the tubular member 693, one or more of the guiding member(s) 641 may engage a surface of the floatation module 695 to guide the tubular member 693 into and/or through the apparatus 601.

As shown and discussed above, an apparatus in accordance with the present disclosure may be used to grip or support one or more tubular members. For example, as shown in one or more embodiments discussed above, the apparatus may include one or more slip assemblies, in which the slip assemblies may be used to grip a tubular member. As such, an apparatus in accordance with the present disclosure may be similar to the gripping apparatus shown and disclosed within the '169 application and the '072 application, both of which were incorporated by reference above. Further, an apparatus in accordance with the present disclosure may be any other gripping or supporting apparatus known in the art. For example, in addition or in alternative to a gripping apparatus, a supporting apparatus may be used in accordance with guiding embodiments disclosed herein that supports one or more tubular members within a drilling rig, such as supporting a tubular string of tubular members suspended from a drilling rig. An example of a supporting apparatus is disclosed within U.S. Pat. No. 6,651,737, filed on Jan. 24, 2001, and entitled "Collar Load Support system and Method," which is incorporated herein by reference above. E.g., the supporting apparatus of U.S. Pat. No. 6,651,737 could be outfitted with guiding member(s), e.g., guiding members disposed about the top and/or bottom openings of the apparatuses disclosed therein.

Figure 7A:
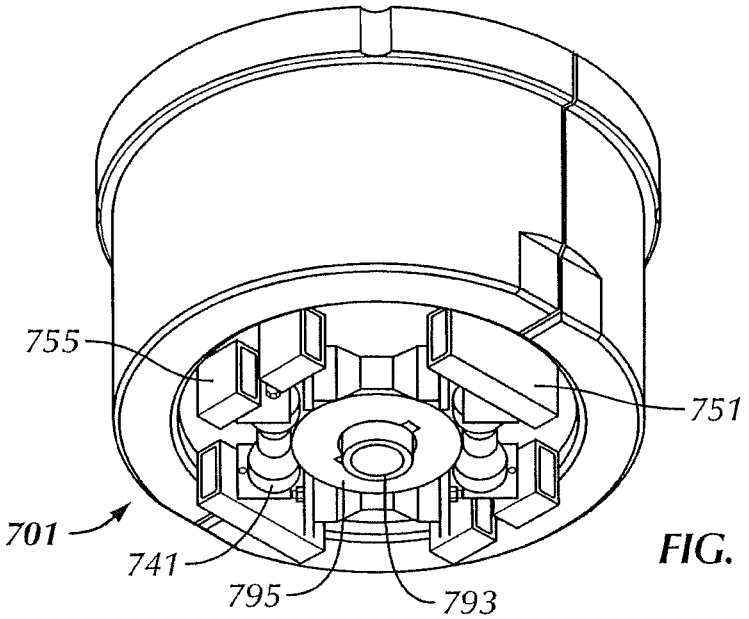
FIGS. 7A and 7B show multiple bottom perspective views of an apparatus guiding a tubular member in accordance with embodiments disclosed herein.
Figure 7B:
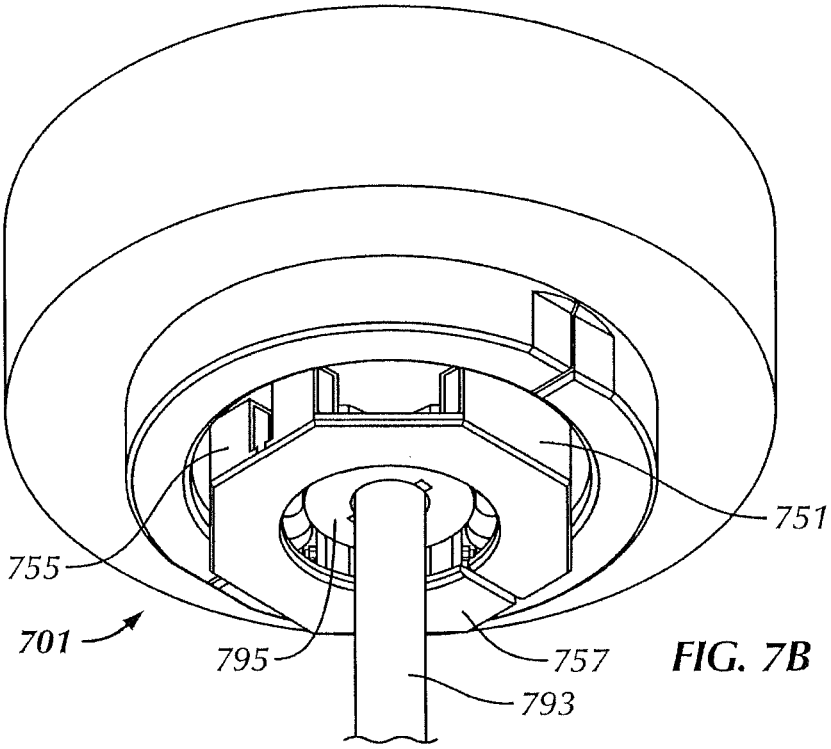

Referring now to FIGS. 7A and 7B, multiple bottom perspective views of an apparatus 701 guiding a tubular member 793 in accordance with embodiments disclosed herein is shown. As with the embodiment shown in FIG. 6, the depicted tubular member 793 has a floatation module 795 disposed about and connected to the tubular member 793.

Further, the apparatus 701 may include one or more guiding members 741 disposed adjacent to one (e.g., top or bottom) opening of a bore of the apparatus 701, or adjacent to each of the two openings (e.g., top and bottom) of the apparatus 701. The apparatus 701 may include a plate assembly 751, in which the one or more guiding members 741 may be connected (e.g., fixed or movably (optionally movable via an actuator)) to the plate assembly 751. As such, the guiding member(s) 741 may be used to guide the tubular member 793 when the tubular member 793 is being disposed within the apparatus 701, such as by having the guiding member(s) engage a surface of the floatation module 795 connected to the tubular member 793. Further, the plate assembly 751 shown in FIG. 7A may only have one plate 755, whereas the plate assembly 751 shown in FIG. 7B may have two plates 755 and 757. As such, as discussed above and in accordance with embodiments disclosed herein, a plate assembly may have multiple structures and/or arrangements, or a plate assembly may not be included within the apparatus at all. In such an embodiment, the guiding member(s) may be attached to the apparatus and/or may be disposed within the apparatus. Thus, the present disclosure contemplates other structures and/or arrangements for the apparatus in accordance with embodiments disclosed herein.

Accordingly, in accordance with one or more embodiments disclosed herein, as the apparatus 741 may include guiding members 741 disposed adjacent to the openings of the apparatus 701, the guiding members 741 are used to contact and guide a tubular member into, within, and/or through the apparatus 741. As such, when guiding the tubular member, guiding members 741 from the top of the apparatus 701 and guiding members 741 from the bottom of the apparatus 701 may be used to establish at least two points-of-contact with the tubular member, such as axially and/or radially spaced points-of-contact. For example, one point-of-contact with the tubular may be axially spaced from another point-of-contact with respect to the axis of the apparatus. Further, in another example, one point-of-contact with the tubular may be radially spaced from another point-of-contact with respect to the axis of the apparatus. By establishing two points-of-contact with the tubular member with the guiding members, this may prevent the tubular member, and other components attached to the tubular member (e.g., floatation module) from contacting the apparatus 701, such as from having the floatation module from contacting a slip assembly (e.g., the gripping surface thereof) of the apparatus 701. For example, at least two axially spaced points-of-contact may prevent a tubular member from contacting a slip assembly of an apparatus 701. Further, at least two radially spaced points-of-contact may be used to guide a tubular member through the bore of an apparatus, for example, such that the guiding members 741 of the apparatus 701 are the only elements that may be able to contact the tubular member and/or buoyancy module(s) connected to the tubular member e.g., when the slip assemblies are in the retracted position. Accordingly, at least two points-of-contact with the tubular member may be used to have a desired orientation and movement of the tubular member into, within, and/or through an apparatus in accordance with one or more embodiments disclosed herein. The slip assemblies may be retractable to a radial distance from the axis to prevent contact with any outer diameter protrusion of a tubular. For example, as discussed below with reference to FIGS. 10A-10D.

Figure 8A:
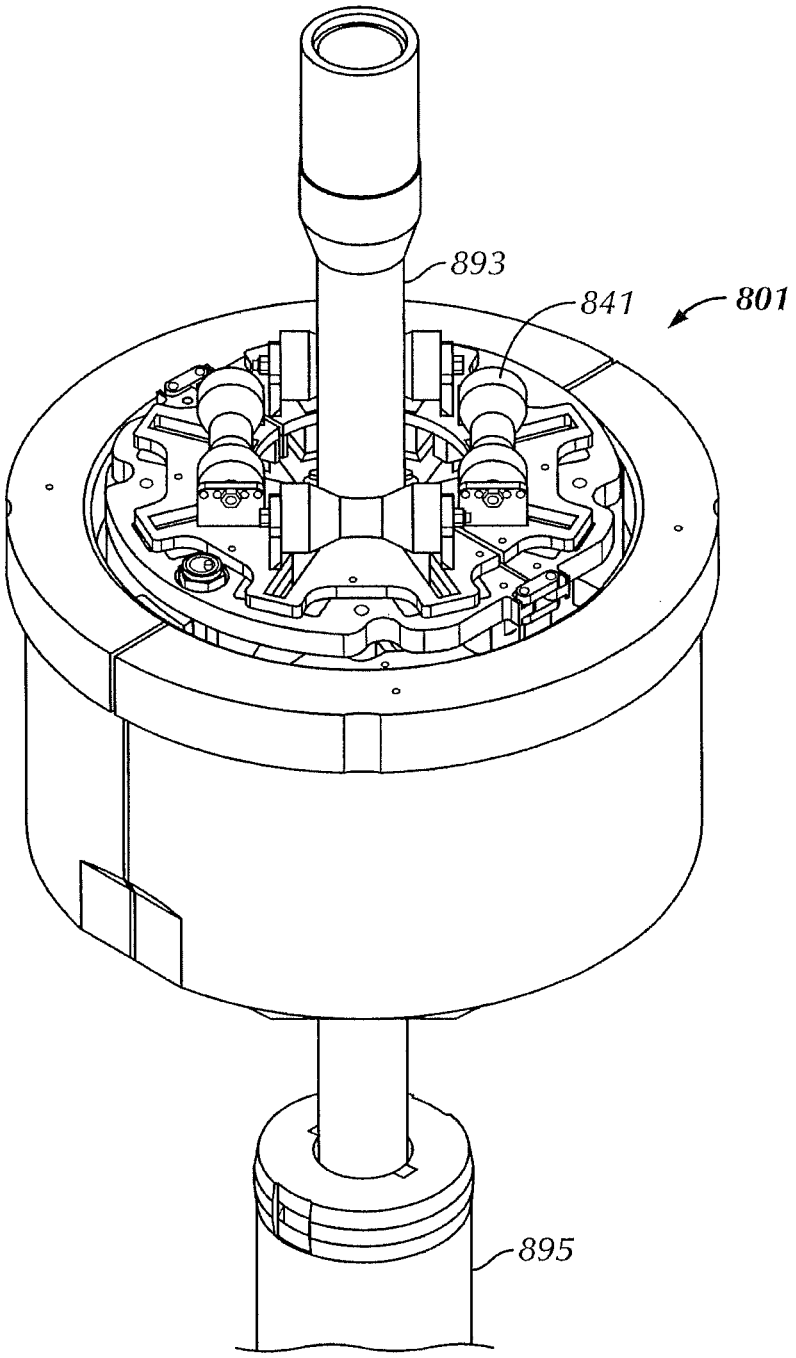
FIGS. 8A-8C show multiple views of an apparatus gripping a tubular member in accordance with embodiments disclosed herein.
Figure 8B:
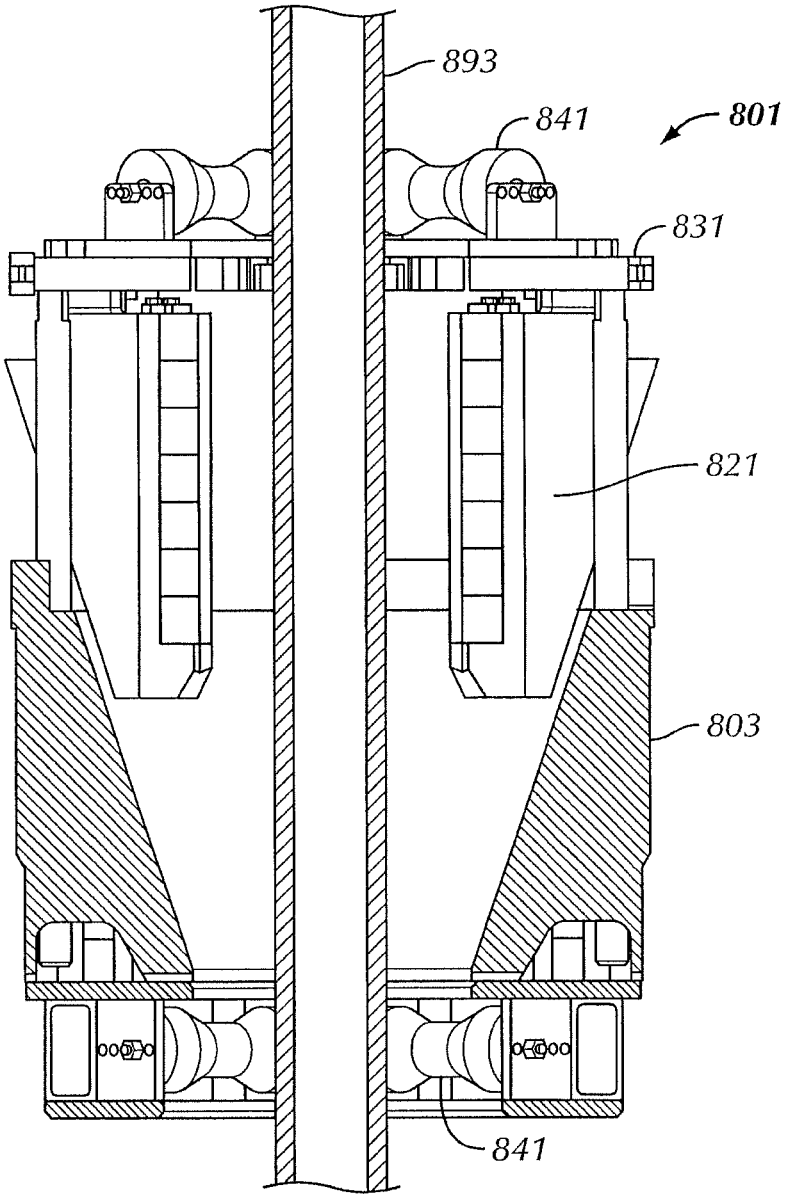
Figure 8C:
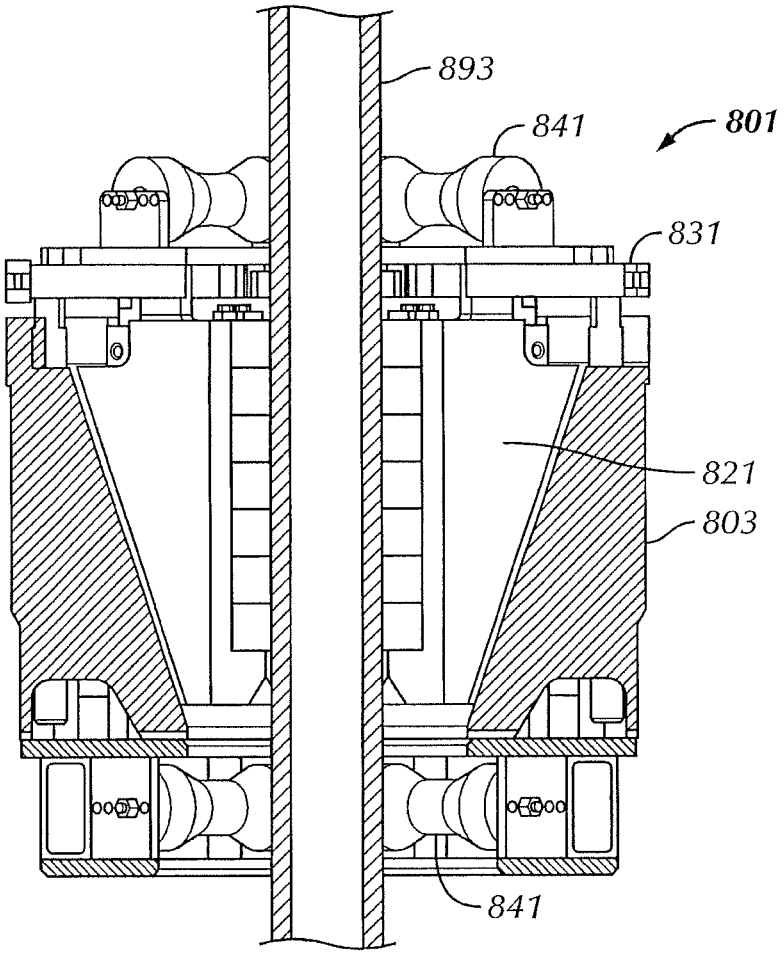

Referring now to FIGS. 8A-8C, multiple views of an apparatus 801 gripping a tubular member 893 in accordance with embodiments disclosed herein is shown. Specifically, FIG. 8A shows a perspective view of the apparatus 801 gripping the tubular member 893, FIG. 8B shows a cross-sectional view of the apparatus 801 disposed about the tubular member 893, and FIG. 8C shows a cross-sectional view of the apparatus 801 gripping the tubular member 893.

As discussed above, an apparatus in accordance with embodiments disclosed herein may be used to grip and support a tubular member, such as when suspending a string of tubular members. As such, in this embodiment, the apparatus 801 is used to grip and support the tubular member 893. Specifically, the apparatus 801 may include a bowl 803 with a plurality of slip assemblies 821 movably connected thereto (e.g., disposed therein), in which the plurality of slip assemblies 821 may move radially inward and longitudinally downward with respect to the longitudinal axis of the bowl 803, e.g., when the tubular member 893 is disposed within the apparatus 801. For example, the slip assemblies 821 may move radially inward and longitudinally downward from a first position, such as a retracted position shown in FIG. 8B, to a second position, such as an engaged position shown in FIG. 8C. As such, the plurality of slip assemblies 821 may be used to grip an outer surface of the tubular member 893.

Further, the depicted tubular member 893 has a floatation module 895 disposed about and connected to the tubular member 893. When a floatation module 895 is disposed into the apparatus 801, the plurality of slip assemblies 821 may be disposed at a first position, such as the retracted position shown in FIG. 8B, which includes having the plurality of slip assemblies 821 extended radially outward and longitudinally upward with respect to the longitudinal axis of the bowl 803. The floatation module 895 may pass through the apparatus 801, such as by having one or more guiding members 841 connected to the apparatus 801 engaging a surface of the floatation module 895 to guide the floatation module 895 and the tubular member 893, at least partially, through the apparatus 801. After the floatation module 895 has passed through the apparatus 801, the plurality of slip assemblies 821 may be disposed at a second position, such as the engaged position shown in FIG. 8C, which includes having the plurality of slip assemblies 821 extended radially inward and longitudinally downward with respect to the longitudinal axis of the bowl 803. This arrangement may allow the plurality of slip assemblies 821 to grip an outer surface of the tubular member 893. However, as discussed above, an apparatus in accordance with the present disclosure may be any other gripping or supporting apparatus known in the art, rather than only the embodiment disclosed in FIGS. 8A-8C.

Further, those having ordinary skill in the art will appreciate that in accordance with one or more embodiments of the present disclosure, one or more guiding member(s) may be disposed adjacent any pipe gripping or supporting apparatus known in the art. As such, the guiding member(s) may be used to guide tubular members, such as tubular members having floatation modules attached thereto, through any gripping or supporting apparatus. In an embodiment, in which guiding member(s) are disposed adjacent to the top side of the apparatus and the bottom side of the apparatus, the guiding member(s) on both the top side and bottom side of the apparatus may be used to guide and prevent contact of the tubular member with other portions of the apparatus.

Further, as shown in FIG. 8B, as the guiding member(s) 841 are disposed adjacent to both the top side of the bowl 803 and the bottom side of the bowl 803, a tubular member with a floatation module may be disposed through the apparatus 801 while preventing contact with the retracted slip assemblies 821. As such, the tubular member and floatation module may be able to contact the guiding member(s) 841 disposed adjacent to both the top side of the bowl 803 and the bottom side of the bowl 803, such as by contacting a guiding member disposed adjacent to the top side of the bowl 803 and a guiding member disposed adjacent to the bottom side of the bowl 803 simultaneously. This may particularly prevent contact of the tubular member and floatation module with the slip assemblies 821 of the apparatus 801.

Figure 9A:
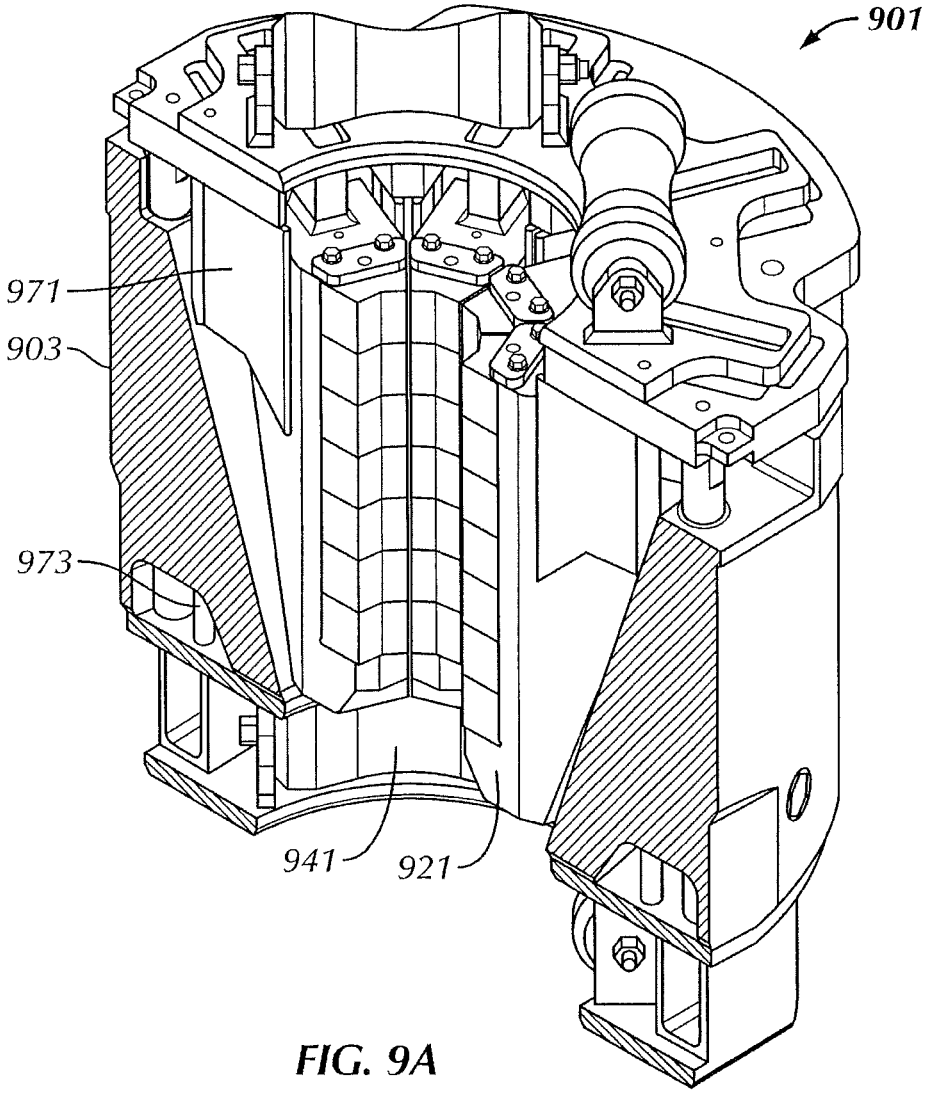
FIGS. 9A-9D show multiple views of an apparatus in accordance with embodiments disclosed herein.
Figure 9B:
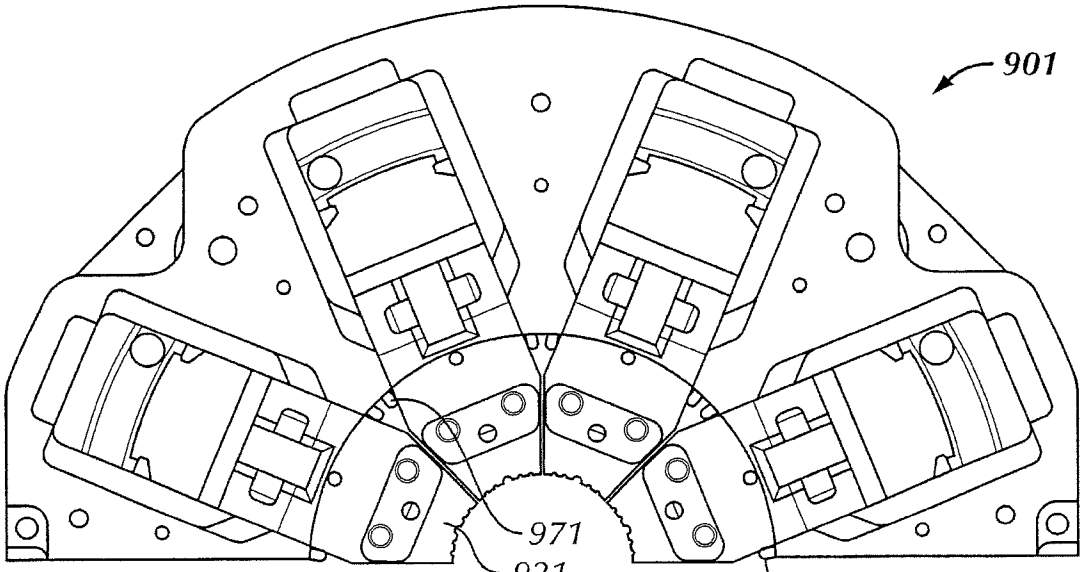
Figure 9C:
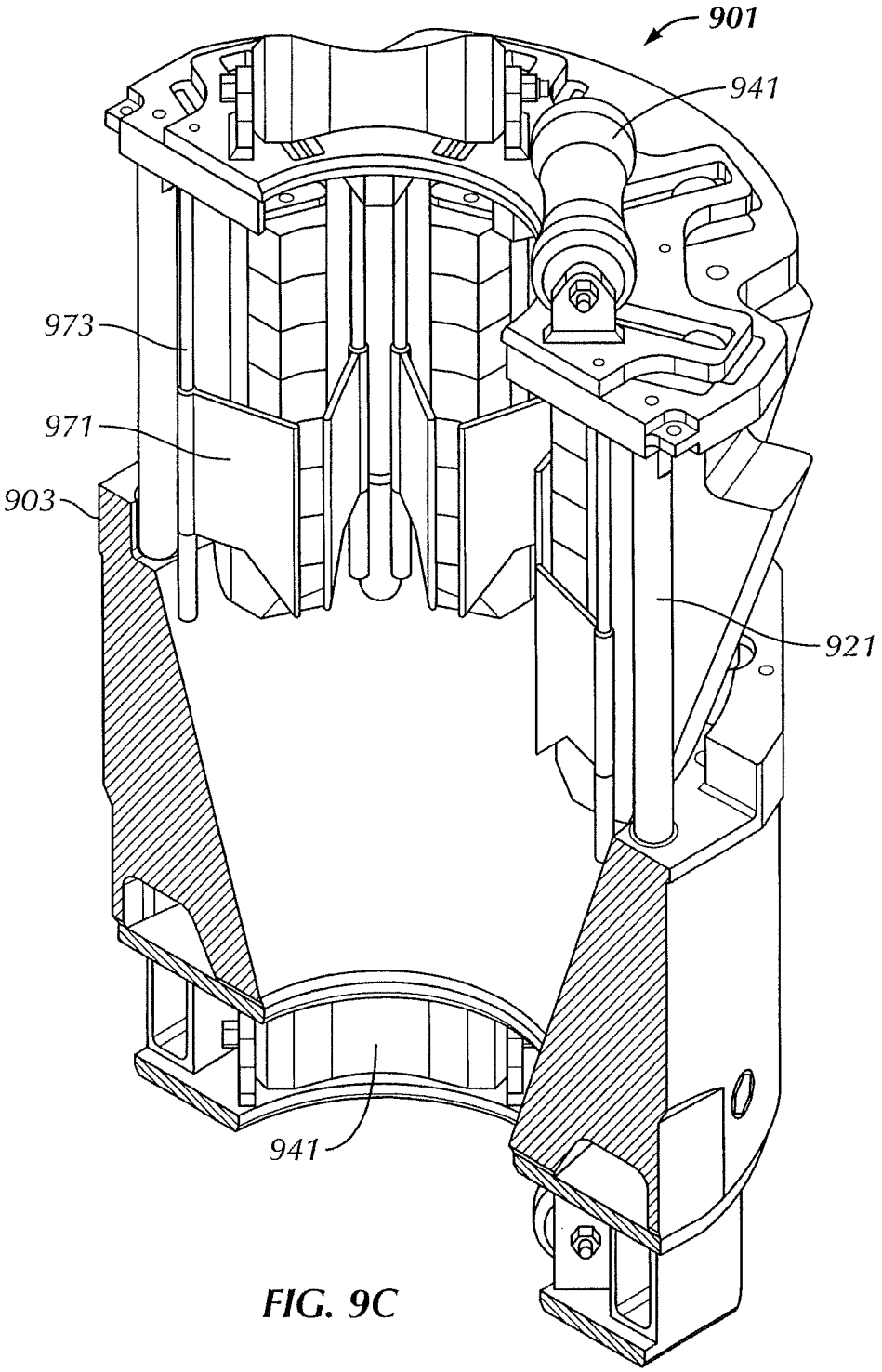
Figure 9D:
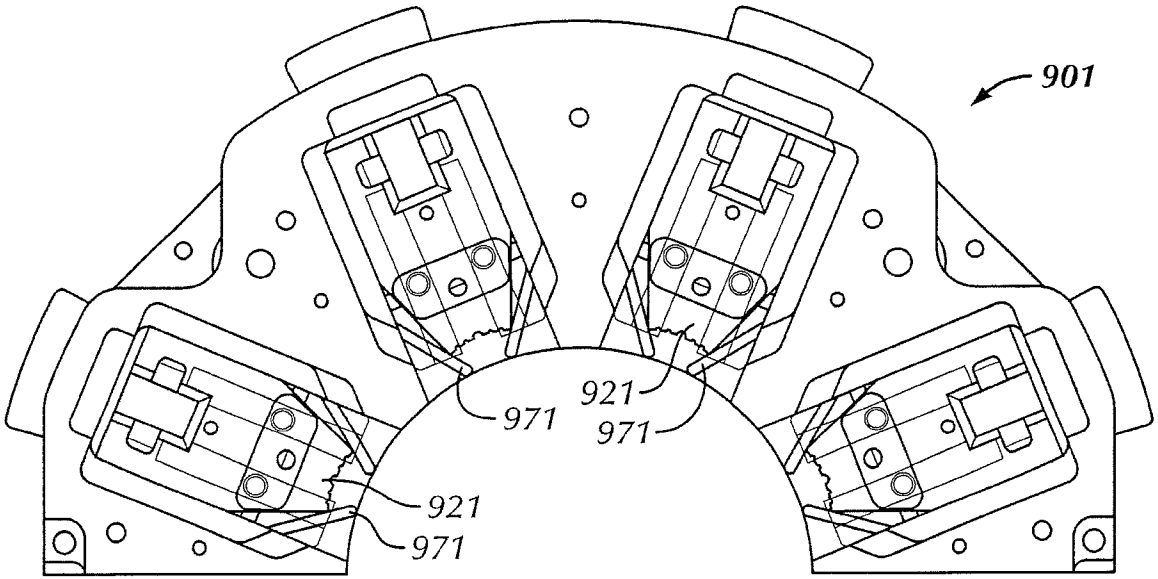

Referring now to FIGS. 9A-9D, multiple views of a gripping apparatus 901 having a plurality of slip assemblies 921 in accordance with embodiments disclosed herein are shown. Specifically, FIGS. 9A and 9B show multiple views of the gripping apparatus 901 with the plurality of slip assemblies 921 in an engaged position, in which FIG. 9A shows a perspective view of the gripping apparatus 901 and FIG. 9B shows an above view of the gripping apparatus 901. Specifically, FIGS. 9C and 9D show multiple views of the gripping apparatus 901 with the plurality of slip assemblies 921 in an retracted position, in which FIG. 9C shows a perspective view of the gripping apparatus 901 and FIG. 9D shows an above view of the gripping apparatus 901.

As discussed above, the apparatus 901 may be used to grip and support a tubular member. For example, the apparatus 901 may include a bowl 903 with the plurality of slip assemblies 921 movably connected thereto, in which the plurality of slip assemblies 921 may move radially inward and outward and longitudinally upward and downward with respect to the longitudinal axis of the bowl 903. As such, the slip assemblies 921 may move radially inward and longitudinally downward from a first position, such as the retracted position shown in FIGS. 9C and 9D, to a second position, such as the engaged position shown in FIGS. 9A and 9B.

Further, a gripping apparatus in accordance with one or more embodiments disclosed herein may include one or more protectors coupled to the gripping apparatus, in which the protectors may be used to protect one or more tools, floatation modules, and/or any other component disposed within the gripping apparatus. For example, as shown in FIGS. 9A-9D, the gripping apparatus 901 may include one or more protectors 971 coupled thereto. Particularly, as shown in this embodiment, the protectors 971 may be movably coupled to the gripping apparatus 901, such as movably connected to or within the bowl 903 of the gripping apparatus 901. The protectors 971 may connect to one or more rods 973, in which the rods 973 may be disposed within and/or through the bowl 903 of the gripping apparatus 901. Further, the rods 973 may be able to rotate with respect to the bowl 903 of the gripping apparatus 901. Protector 971 connected to a rod 973 (rotatable or not) may be able to rotate about the rod 973 with respect to the bowl 903 of the apparatus 901.

As shown, as the protectors 971 are movable with respect to the apparatus 901, the protectors 971 may move as the slip assemblies 921 move within the apparatus 901. As such, as shown in FIGS. 9A and 9B, with the plurality of slip assemblies 921 in an engaged position, the protectors 971 may enable the slip assemblies 921 to pass between one or more of the protectors 971 to have the slip assemblies 921 move radially inward and longitudinally downward with respect to the axis of the apparatus 901. Further, as shown in FIGS. 9C and 9D, with the plurality of slip assemblies 921 in the retracted position, the protectors 971 may close about the slip assemblies 921 and cover at least a portion of the slip assemblies 921. One or more of the protectors 971, thus, may be biased, for example, an actuator, spring and/or other biasing mechanism may be used to bias one or more of the protectors into the position as shown in FIGS. 9C and/or 9D. Protectors 971 thus may protect one or more tubular and/or floatation modules that may be disposed within and/or through the apparatus 901, such as by preventing a tubular and/or floatation module from contacting the slip assemblies 921 of the apparatus 901 when disposed within the apparatus 901. Protector 971 may extend axially the entire length of a slip assembly 921, and/or may be less than the entire length of the slip assemblies 921 (e.g., that part of the slip assembly having teeth or other gripping surface).

As shown, a protector 971 may be disposed on each side of each slip assembly 921 included with the apparatus 901.

However, those having ordinary skill in the art will appreciate that the present disclosure is not so limited, as the present disclosure contemplates multiple structures and arrangements for protectors within a gripping apparatus. For example, in one embodiment, a protector may be disposed on only one side of a (e.g., each) slip assembly within the apparatus, or, in another embodiment, only one protector may be included within the apparatus altogether. As such, multiple structures and arrangements may be used for the protectors of an apparatus without departing from the scope of the present disclosure.

Referring now to FIG. 10A-10D, multiple views of a portion of a gripping apparatus 1001 in accordance with embodiments disclosed herein are shown. Specifically, FIGS. 10A-10D show a portion of gripping apparatus 1001 with a tubular member 1093 disposed therein.

The gripping apparatus 1001 may be used to guide the tubular member 1093 with one or more guiding members 1041, in which the guiding members 1041 may be movably connected to the apparatus 1001. For example, the guiding members 1041 may be able to rotate with respect to the apparatus 1001. However, as discussed above, the guiding members 1041 may be able to move with respect to the longitudinal axis of the apparatus 1001, such as move radially with respect to the longitudinal axis of the apparatus 1001. As such, in FIGS. 10A and 10B, the guiding members 1041 are disposed at a first radial position with respect to the longitudinal axis of the apparatus 1001, and in FIGS. 10C and 10D, the guiding members 1041 are shown as disposed at a second radial position with respect to the longitudinal axis of the apparatus 1001. Accordingly, one or more of the guiding members 1041 may be movable between multiple radial positions, such as movable between the first radial position shown in FIGS. 10A and 10B and the second radial position shown in FIGS. 10C and 10D.

Figure 10A:
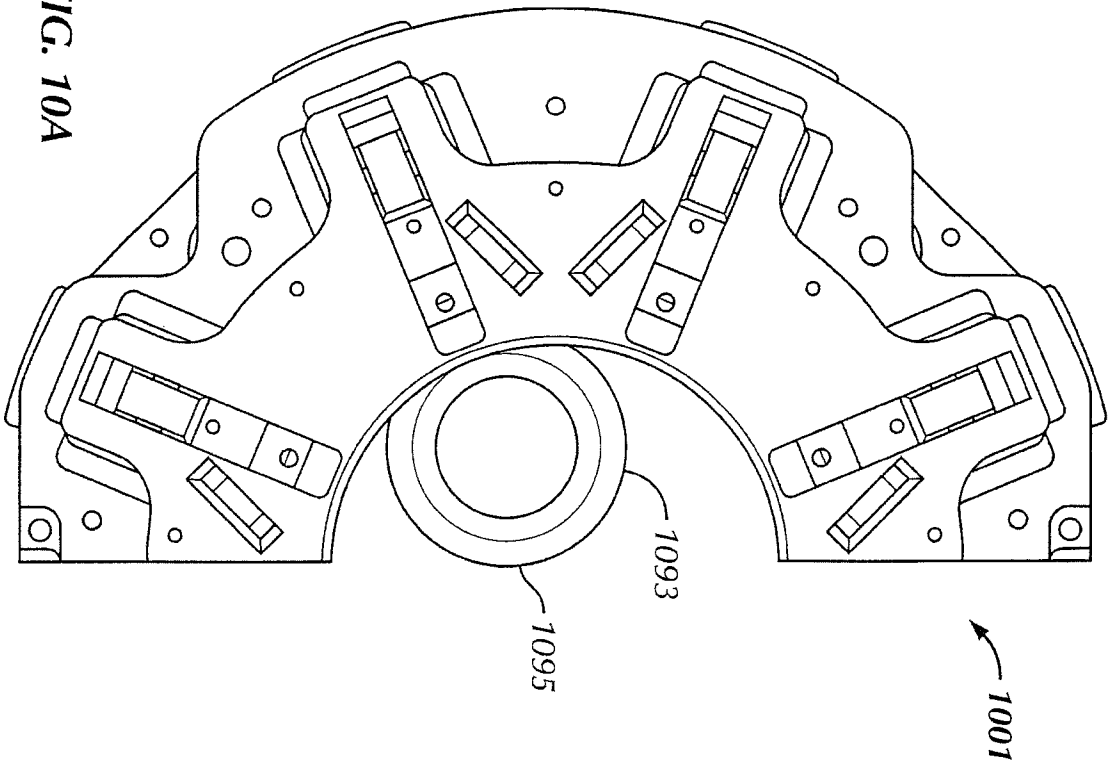
FIGS. 10A-10D show multiple views of a portion of an apparatus in accordance with embodiments disclosed herein.
Figure 10B:
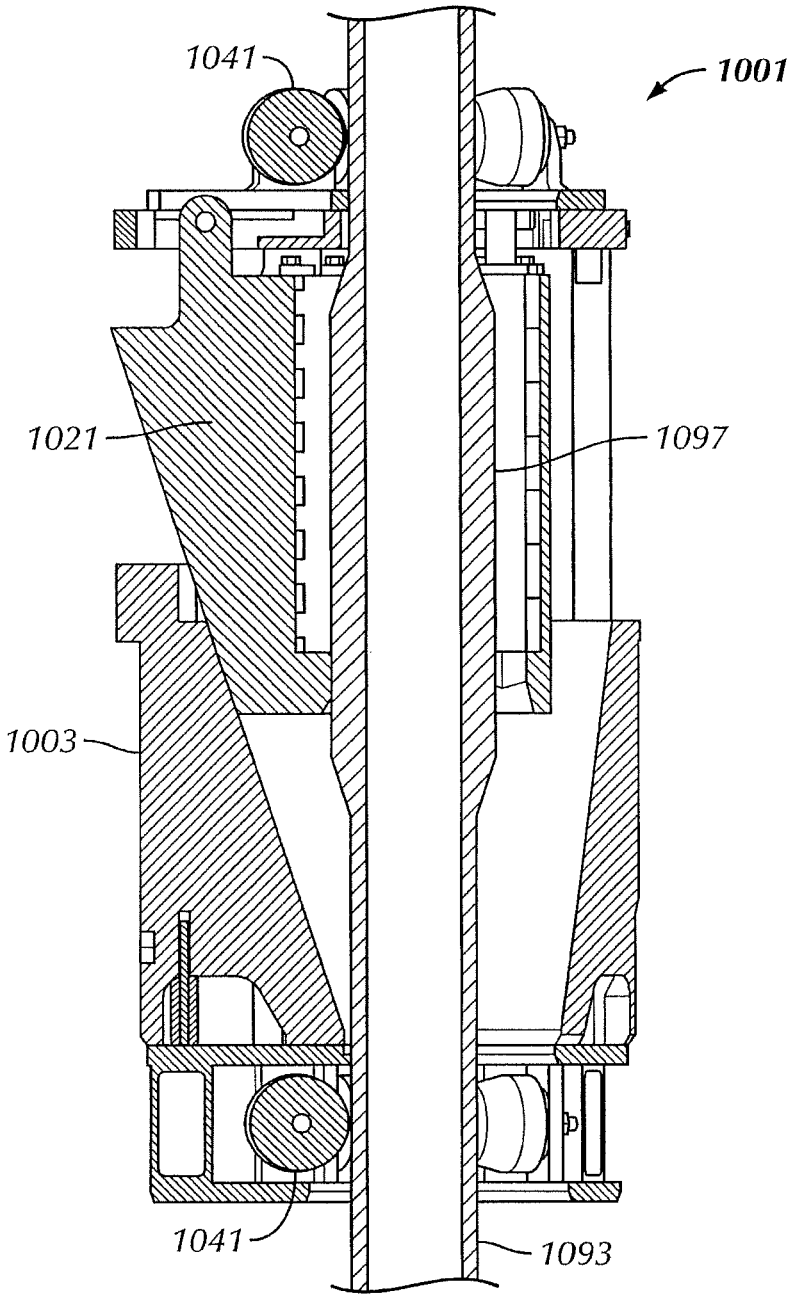
Figure 10C:
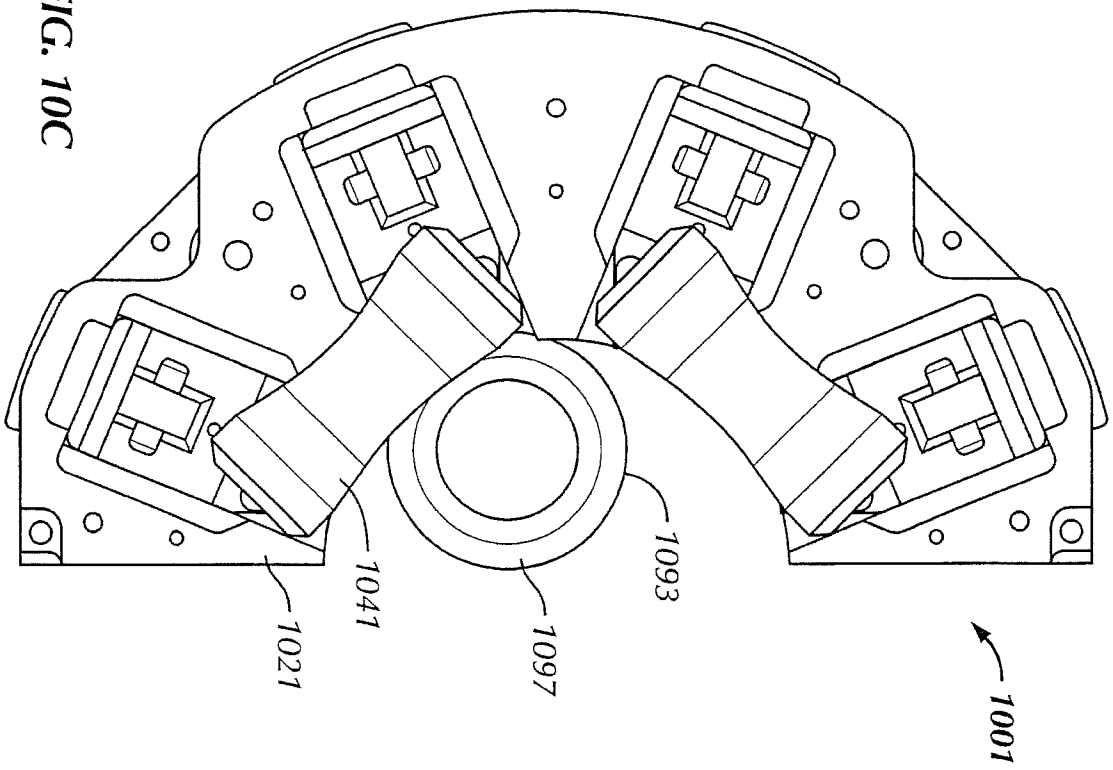
Figure 10D:
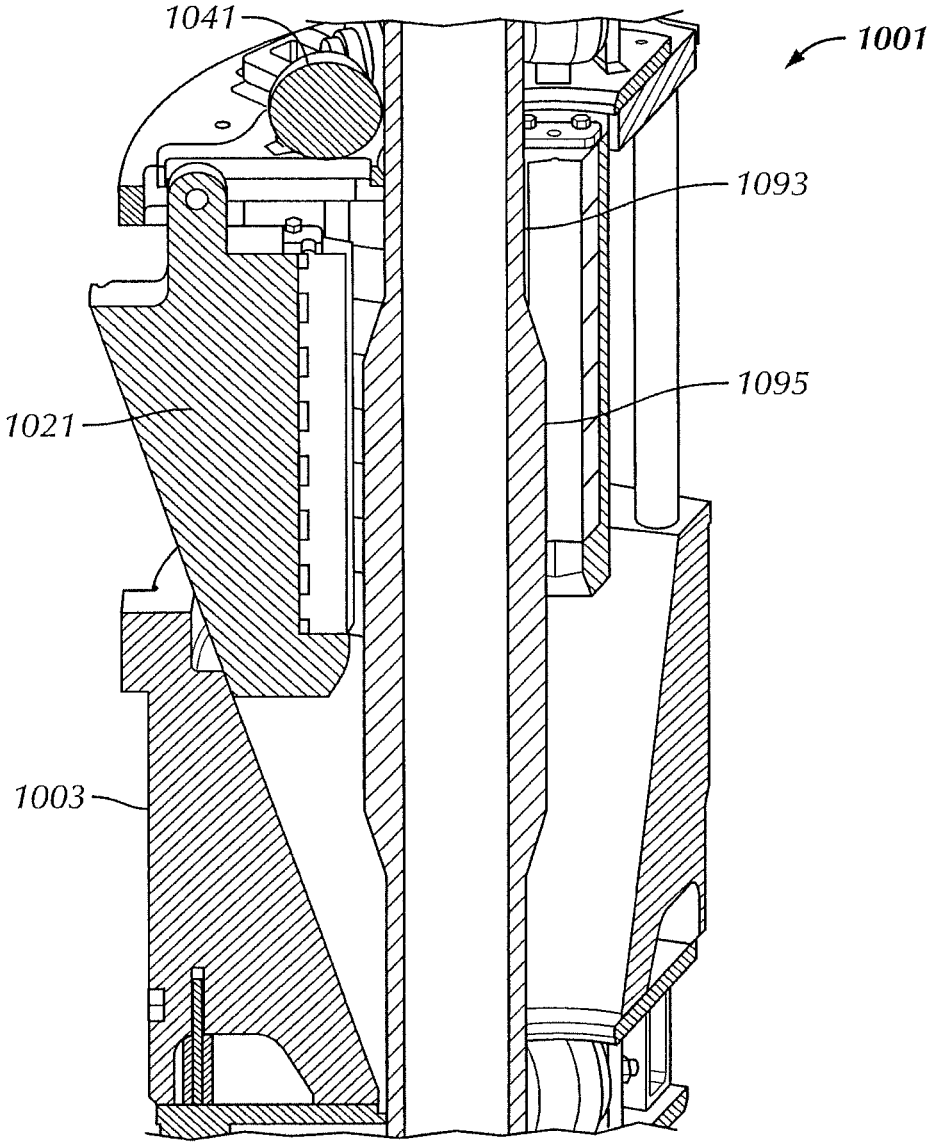

In one embodiment, as the guiding members may be radially movable with respect to the longitudinal axis of the apparatus, the guiding members may be moved radially to prevent damage to a tubular member, to prevent damage to a tool, to prevent damage to a floatation module attached to a tubular member, and/or to prevent damage to any other component that may be disposed within and/or through a gripping apparatus in accordance with one or more embodiments disclosed herein. As such, as shown in FIGS. 10A and 10B, the guiding members 1041 are shown as disposed in the first radial position, in which in this radial position, the floatation module 1095 attached to the tubular member 1093 may interfere with one or more of the slip assemblies 1021 within the apparatus 1001. Further, this interference may cause a component of or attached to the tubular member 1093 to be damaged. For example, a collar 1097 of the tubular member 1093 (e.g., casing), which may have a larger outer diameter than the tubular member 1093, may interfere with the slip assemblies 1021, even though the tubular member 1093 is being guided by guide member 1041. Furthermore, the axial length of the component, which may have a larger diameter than the tubular member, may be shorter than the axial length between the guide members. This may enable the component attached to the tubular member to interfere with one or more slip assemblies of the apparatus, even though the tubular member is being guided by the guiding members.

As such, the guiding members 1041 may be moved further radially inward with respect to the longitudinal axis of the apparatus 1001, and/or the slip assemblies 1021 may be moved further radially outward, to prevent interference (e.g., damage) to the tubular member 1093 and components thereof, such as the collar 1097 or a floatation module. For example, the guiding members 1041 may be disposed in a second radial position, which is closer to the longitudinal axis than the first radial position. In this radial position, the tubular member 1093, and any component attached thereto, may be prevented from interfering with the slip assemblies 1021 within the apparatus 1001. Further, in one or more embodiments, the slip assemblies 1021 may be moved radially outward with respect to the longitudinal axis of the apparatus 1001 such that the tubular member 1093, and any component attached thereto, may be prevented from interfering with the slip assemblies 1021 within the apparatus 1001. Accordingly, even though a component may be attached to a tubular member when in use with an apparatus or method in accordance with the present disclosure, the guiding members and/or the slip assemblies may be used to prevent interference with the tubular member (and components thereof) and the slip assemblies of the apparatus. For example, in one embodiment, even though a tubular member may have a component attached thereto, as the component passes within, into, and/or through the apparatus, the guiding members and/or the slip assemblies may be positioned to prevent interference with the component of the tubular member and the slip assemblies.

Accordingly, in one embodiment, one or more of the guiding members of the present disclosure may be disposed at a location that is radially closer to the longitudinal axis of the apparatus than the location of one or more slip assemblies of the apparatus. As such, the guiding members of the present disclosure may be used to prevent damage to a tubular member, a tool, a floatation module, and/or any other component that may be disposed within and/or through a gripping apparatus in accordance with one or more embodiments disclosed herein. As discussed above, the guiding members may be movable through the use of an actuator coupled thereto. Further, as discussed above, one or more protectors may be disposed adjacent to one or more of the slip assemblies, such as to prevent contact between the slip assemblies and a tubular member and/or a component attached thereto. However, those having ordinary skill in the art will appreciate that the present disclosure is not so limited, as other embodiments, arrangements, and components may be used for an apparatus in accordance with embodiments disclosed herein without departing from the scope of the present disclosure.

As discussed above, one or more (or all) of the guiding members may be driven by an actuator, e.g., driven towards and/or away from the longitudinal axis of the bore of the gripping apparatus. As such, in one embodiment, the guiding members may comprise an actuator to move the guiding members between the first position, shown in FIGS. 10A and 10B, and the second position, shown in FIGS. 10C and 10D. Further, as also discussed above, the guiding members having actuators connected thereto may be controlled by a processor or other control system to dispose one or more of the guiding members at a desired location (e.g., a desired distance from the axis of the bore of the tool).

Figure 11:
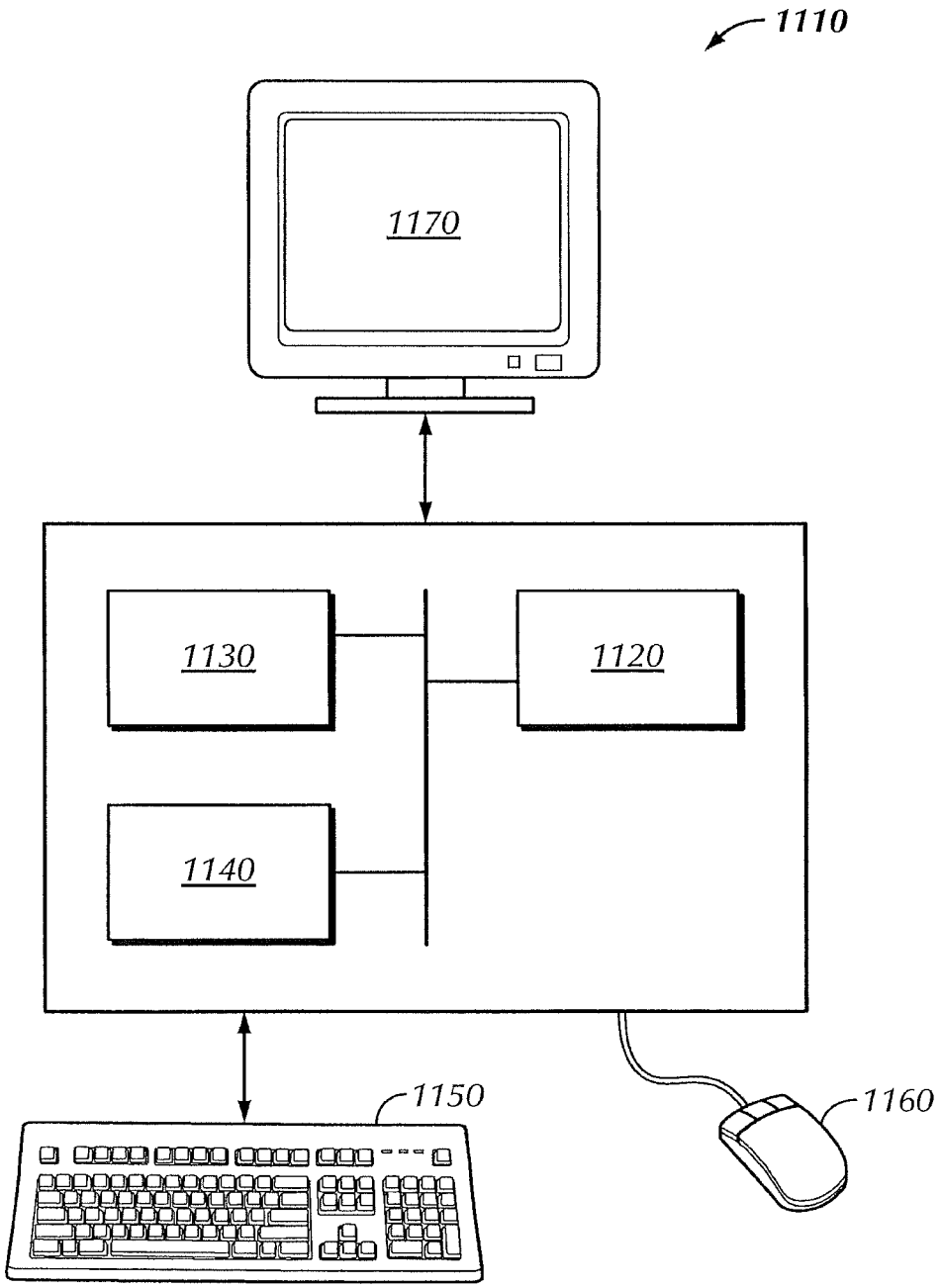
FIG. 11 shows a computer system that may be used in accordance with an embodiment disclosed herein.

Accordingly, aspects of embodiments disclosed herein, such as controlling and/or moving one or more guiding members, slip assemblies, actuators and/or controlling and moving any other components of a gripping apparatus, may be implemented on any type of control system, e.g., hydraulic, pneumatic, electric and/or mechanical system. A control system may comprise sensor(s) and/or actuator(s). A control system may comprise a computer regardless of the platform being used. For example, as shown in FIG. 11, a networked computer system 1110 that may be used in accordance with an embodiment disclosed herein includes a processor 1120, associated memory 1130, a storage device 1140, and numerous other elements and functionalities typical of today's computers (not shown). The networked computer system 1110 may also include input means, such as a keyboard 1150 and a mouse 1160, and output means, such as a monitor 1170. The depicted networked computer system 1110 is connected to a local area network (LAN) or a wide area network (e.g., the Internet) (not shown) via a network interface connection (not shown). Those skilled in the art will appreciate that these input and output means may take many other forms. Additionally, the computer system may not be connected to a network. Further, those skilled in the art will appreciate that one or more elements of aforementioned computer 1110 may be located at a remote location and connected to the other elements over a network. As such, a computer system, such as the networked computer system 1110, and/or any other computer system known in the art may be used in accordance with embodiments disclosed herein.

It should be understood that the present disclosure contemplates a method to guide a tubular member, such as when assembling a string of tubular members together, e.g., using a gripping apparatus. One or more of the tubular members may have a floatation module disposed thereabout, in which the tubular member with the floatation device may be guided through a bore of the apparatus. The present disclosure also contemplates a method to assemble an apparatus used to guide a tubular member.

Further, it should be understood that the present disclosure contemplates using an apparatus in accordance with embodiments disclosed herein within one, or multiple, drilling rigs. For example, embodiments disclosed herein provide an apparatus that may be used to guide a tubular member. As such, when assembling a string of tubular members to each other, such as within a drilling rig, the apparatus may be used to assist and support the string of tubular members.

Embodiments disclosed herein may provide for one or more of the following advantages. First, embodiments disclosed herein may provide for an apparatus that may be used to guide a tubular member, such as a tubular member having a floatation module connected thereto. Further, embodiments disclosed herein may provide for an apparatus that may be used to support a tubular member and/or a string of tubular members. In such embodiments, the apparatus may be used to prevent damage, at least partially, from occurring to a tubular member and/or a floatation module connected to the tubular member.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the invention should be limited only by the attached claims.

What is claimed is:

1. A system comprising:

an apparatus having a bore with a longitudinal axis extending therethrough, the apparatus having a first opening formed at a first side thereof, a second opening formed at a second side thereof, and an inner wall extending from the first opening to the second opening, defining a bore;

a first guiding member disposed adjacent to the first opening of the bore, the first guiding member comprising a first plurality of rollers;

a second guiding member disposed adjacent to the second opening of the bore, the second guiding member comprising a second plurality of rollers;

a tubular member disposed through the bore of the apparatus; and a floatation module formed of a buoyant, high density foam, the floatation module attached to an outer diameter of the tubular member, wherein the tubular member is supported by the apparatus, wherein the first guiding member and the second guiding member are configured to contact the floatation module, wherein at least one of the first guiding member and the second guiding member is movably connected to the apparatus, wherein one of the first guiding member and the second guiding member comprises a plate assembly, and wherein the plate assembly is removably connected on the second side of the bore.

2. The system of claim 1, wherein the apparatus further comprises a slip assembly disposed therein and movable with respect to a longitudinal axis of the apparatus.

3. The system of claim 2, wherein the slip assembly is movable between an engaged position to contact an outer surface of the tubular member and at least one disengaged position to disengage from the outer surface of the tubular member.

4. The system of claim 3, wherein the slip assembly of the apparatus is disposed below a floor of a drilling rig in at least one of the engaged position and the at least one disengaged position.

5. The system of claim 3, wherein, in the at least one disengaged position, the slip assembly is configured to enable the tubular member and floatation module attached thereto to pass along and through the bore of the apparatus.

6. A method to manufacture an apparatus to guide a tubular member having a floatation module attached thereto, the method comprising:

providing a bowl having a bore formed therein, wherein the bore is defined about a longitudinal axis with a slip assembly movably disposed within the bowl;

disposing a first guiding member adjacent to a first opening of the bore, the first guiding member comprising a first plurality of rollers;

disposing a second guiding member adjacent to a second opening of the bore, the second guiding member comprising a second plurality of rollers, wherein at least one of the first guiding member and the second guiding member is movably connected to the bowl, wherein one of the first guiding member and the second guiding member comprises a plate assembly, and wherein the plate assembly is removably connected on a second side of the bowl;

disposing a tubular member having a floatation module connected thereto through the apparatus, the floatation module being formed of a buoyant, high density foam; and contacting the floatation module with a guiding surface of at least one of the first guiding member and the second guiding member.

7. The method of claim 6, wherein the slip assembly is movable between an engaged position to contact an outer surface of the tubular member and at least one disengaged position to disengage from the outer surface of the tubular member.

8. The method of claim 7, wherein, in the at least one disengaged position, the slip assembly is configured to enable the tubular member and floatation module attached thereto to pass along and through the bore of the apparatus.

9. An apparatus comprising:

a bowl having a bore formed therein, wherein the bore is defined about a longitudinal axis with a slip assembly movably disposed within the bowl;

a first guiding member adjacent to a first opening of the bore;

a second guiding member adjacent to an opposing second opening of the bore;

a tubular member disposed within the bowl, wherein the tubular member is part of one of a casing string and a landing string;

a floatation module connected to an outer diameter of the tubular member, the floatation module being formed of a buoyant, high density foam; and an actuator connected to at least one of the first guiding member and the second guiding member such that the actuator moves the at least one of the first guiding member and the second guiding member.

10. The apparatus of claim 9, wherein a load of the tubular member is reduced by the attachment of the floatation module when the floatation module is used subsea.

11. The apparatus of claim 9, wherein an outer diameter of the floatation module is larger than an outer diameter of the tubular member.

* * * * *